US008323724B2

(12) United States Patent
Shinohara

(10) Patent No.: US 8,323,724 B2
(45) Date of Patent: Dec. 4, 2012

(54) LIQUID DROPLET DISCHARGING APPARATUS, LIQUID DISCHARGING METHOD, COLOR FILTER PRODUCING METHOD, AND ORGANIC EL DEVICE PRODUCING METHOD

(75) Inventor: Toru Shinohara, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 610 days.

(21) Appl. No.: 12/401,251

(22) Filed: Mar. 10, 2009

(65) Prior Publication Data

US 2009/0244134 A1 Oct. 1, 2009

(30) Foreign Application Priority Data

Apr. 1, 2008 (JP) ..... 2008-094724

(51) Int. Cl.
*B05D 5/12* (2006.01)
*B41J 29/38* (2006.01)

(52) U.S. Cl. ..... 427/66; 427/466; 427/469; 347/10; 430/7; 222/1

(58) Field of Classification Search ..... None
See application file for complete search history.

(56) References Cited

U.S. PATENT DOCUMENTS 6,257,689 B1 * 7/2001 Yonekubo ..... 347/11
6,286,926 B1 * 9/2001 Hirabayashi et al. ..... 347/17
6,331,040 B1 * 12/2001 Yonekubo et al. ..... 347/15
6,660,332 B2 * 12/2003 Kawase et al. ..... 427/266
6,802,589 B2 * 10/2004 Yonekubo et al. ..... 347/29
7,073,727 B2 7/2006 Usuda
7,111,755 B2 * 9/2006 Koyama et al. ..... 222/1
7,237,859 B2 * 7/2007 Usuda ..... 347/9
7,244,007 B2 * 7/2007 Ishizaki ..... 347/5
7,258,408 B2 * 8/2007 Usuda ..... 347/11
7,404,612 B2 * 7/2008 Takamiya et al. ..... 347/11
7,686,413 B2 * 3/2010 Takamiya et al. ..... 347/14
7,726,759 B2 * 6/2010 Takata ..... 347/13
7,798,592 B2 * 9/2010 Mizugaki ..... 347/15
2007/0070102 A1 * 3/2007 Takata ..... 347/10

(Continued)

FOREIGN PATENT DOCUMENTS

JP 2002-221616 A 8/2002

(Continued)

*Primary Examiner* — Jeffrey Wollschlager
(74) *Attorney, Agent, or Firm* — Global IP Counselors, LLP

(57) ABSTRACT

A liquid droplet discharging apparatus includes a substrate having a plurality of film formation regions; a plurality of nozzles discharging droplets of a liquid, the nozzles being positioned facing the substrate and moved relatively with respect to the substrate to perform a scanning operation so as to discharge the droplets in the film formation regions during the scanning operation; a first moving mechanism moving the substrate relatively with the nozzles in a first direction; a plurality of driving units provided, each corresponding to one of the nozzles; a nozzle driving section generating a plurality of driving signals to supply one of the driving signals changing amounts of the droplets to be discharged to the driving units so as to allow the droplets to be discharged from the nozzles; and a control section controlling the first moving mechanism to allow the scanning operation to be performed a plurality of times over a same film formation region and controlling the nozzle driving section to allow a predetermined amount of the liquid to be discharged as droplets in the same film formation region during the plurality of times of the scanning operations and to change the driving signal applied to the driving units corresponding to nozzles positioned over the film formation region among the nozzles in each of the scanning operations.

4 Claims, 13 Drawing Sheets

U.S. PATENT DOCUMENTS

2007/0211092 A1* 9/2007 Shingyohuchi et al. ..... 347/10

FOREIGN PATENT DOCUMENTS

JP 2003-320291 A 11/2003
JP 2004-090621 A 3/2004
JP 2005-21862 A 1/2005
JP 2005-47208 A 2/2005
JP 2005-062833 A 3/2005
JP 2005-93099 A 4/2005
JP 2006-346575 A 12/2006

* cited by examiner

FIG.10A

| | Gr1 | Gr2 | Gr3 | Gr4 |
|---|---|---|---|---|
| SELECTION 1 | COM1 | COM1 | COM1 | COM1 |
| SELECTION 2 | COM2 | COM2 | COM2 | COM2 |
| SELECTION 3 | COM3 | COM3 | COM3 | COM3 |
| SELECTION 4 | COM4 | COM4 | COM4 | COM4 |
| SELECTION 5 | COM1 | COM2 | COM3 | COM4 |
| SELECTION 6 | COM1 | COM2 | COM4 | COM3 |
| SELECTION 7 | COM1 | COM3 | COM4 | COM2 |
| SELECTION 8 | COM1 | COM3 | COM2 | COM4 |
| SELECTION 9 | COM1 | COM4 | COM3 | COM2 |
| SELECTION 10 | COM1 | COM4 | COM2 | COM3 |
| SELECTION 11 | COM2 | COM1 | COM3 | COM4 |
| SELECTION 12 | COM2 | COM1 | COM4 | COM3 |
| SELECTION 13 | COM2 | COM3 | COM1 | COM4 |
| SELECTION 14 | COM2 | COM3 | COM4 | COM1 |
| SELECTION 15 | COM2 | COM4 | COM3 | COM1 |
| SELECTION 16 | COM2 | COM4 | COM1 | COM3 |
| SELECTION 17 | COM3 | COM1 | COM2 | COM4 |
| SELECTION 18 | COM3 | COM1 | COM4 | COM2 |
| SELECTION 19 | COM3 | COM2 | COM1 | COM4 |
| SELECTION 20 | COM3 | COM2 | COM4 | COM1 |
| SELECTION 21 | COM3 | COM4 | COM1 | COM2 |
| SELECTION 22 | COM3 | COM4 | COM2 | COM1 |
| SELECTION 23 | COM4 | COM1 | COM2 | COM3 |
| SELECTION 24 | COM4 | COM1 | COM3 | COM2 |
| SELECTION 25 | COM4 | COM2 | COM1 | COM3 |
| SELECTION 26 | COM4 | COM2 | COM3 | COM1 |
| SELECTION 27 | COM4 | COM3 | COM1 | COM2 |
| SELECTION 28 | COM4 | COM3 | COM2 | COM1 |

FIG.10B

| | Gr1 | Gr2 | Gr3 | Gr4 |
|---|---|---|---|---|
| SELECTION 7 | COM1 | COM3 | COM4 | COM2 |
| SELECTION 9 | COM1 | COM4 | COM3 | COM2 |
| SELECTION 14 | COM2 | COM3 | COM4 | COM1 |
| SELECTION 15 | COM2 | COM4 | COM3 | COM1 |

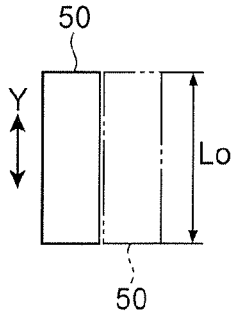

| NOZZLE GROUP | FIRST MAIN SCANNING | SECOND MAIN SCANNING |
|---|---|---|
| Gr1 | COM1 | COM2 |
| Gr2 | COM3 | COM4 |
| Gr3 | COM4 | COM3 |
| Gr4 | COM2 | COM1 |

FIG.11A

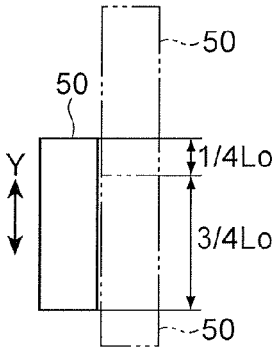

| FIRST MAIN SCANNING | | SECOND MAIN SCANNING | | THIRD MAIN SCANNING | |
|---|---|---|---|---|---|
| NOZZLE GROUP | DRIVING SIGNAL | NOZZLE GROUP | DRIVING SIGNAL | NOZZLE GROUP | DRIVING SIGNAL |
| Gr1 | COM1 | | | Gr4 | COM1 |
| Gr2 | COM3 | Gr1 | COM2 | | |
| Gr3 | COM4 | Gr2 | COM4 | | |
| Gr4 | COM2 | Gr3 | COM3 | | |

FIG.11B

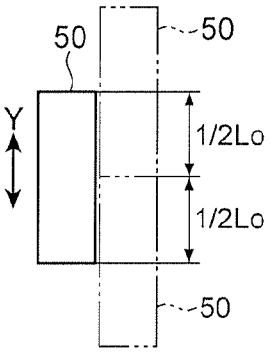

| FIRST MAIN SCANNING | | SECOND MAIN SCANNING | | THIRD MAIN SCANNING | |
|---|---|---|---|---|---|
| NOZZLE GROUP | DRIVING SIGNAL | NOZZLE GROUP | DRIVING SIGNAL | NOZZLE GROUP | DRIVING SIGNAL |
| Gr1 | COM1 | | | Gr3 | COM3 |
| Gr2 | COM3 | | | Gr4 | COM1 |
| Gr3 | COM4 | Gr1 | COM2 | | |
| Gr4 | COM2 | Gr2 | COM4 | | |

FIG.11C

LIQUID DROPLET DISCHARGING APPARATUS, LIQUID DISCHARGING METHOD, COLOR FILTER PRODUCING METHOD, AND ORGANIC EL DEVICE PRODUCING METHOD

BACKGROUND

1. Technical Field

The present invention relates to a liquid droplet discharging apparatus capable of drawing by discharging droplets of a liquid on a target object, a method for discharging a liquid, a method for producing a color filter by using the discharging apparatus and the liquid discharging method, and a method for producing an organic EL device.

2. Related Art

Recently, much attention has been paid on production of various functional devices by discharging droplets of a functional-material containing liquid on a target object such as a substrate, using a liquid droplet discharging method. Typical functional devices are color filters, organic electro luminescence (EL) elements, and the like.

For production of the functional devices, one critical issue is to form a homogeneous and even functional film on the target object to obtain desired characteristics. To solve the issue, there is disclosed a method for producing a color filter in JP-A-2002-221616 (p. 5) (a first example of related art). The disclosed method includes moving a substrate relatively with respect to inkjet heads each having a nozzle line formed by linearly arranging a plurality of nozzles and divided into a plurality of nozzle-line groups and discharging a filter material selectively from the nozzles to form a filter element on the substrate.

The color filter producing method includes moving either one of the inkjet heads or the substrate relatively with respect to the other one of the heads or the substrate to perform sub-scanning such that at least a part of the nozzle-line groups can scan the same part of the substrate in a main-scanning direction. Thereby, even if an amount of ink discharged varies among the nozzles, the ink as the filter material is discharged from nozzles belonging to different nozzle-line groups. This can prevent unevenness of film thickness among the filter elements. In short, the above color filter production method allows variation of discharge amount among the nozzles to be distributed among the nozzles.

As a liquid droplet discharging apparatus capable of discharging a plurality of kinds of liquids, there is known a liquid droplet discharging apparatus disclosed in JP-A-2006-346575 (p. 5) (a second example of related art). The disclosed apparatus includes a carriage having a plurality of liquid droplet discharging heads each discharging a different kind of liquid; a moving unit moving the discharging heads relatively with respect to a workpiece in a main-scanning direction and a sub-scanning direction in a state in which the discharging heads face the workpiece; and a drawing control unit selectively driving the discharging heads to allow the heads to discharge a plurality of kinds of liquids on the workpiece in sync with main scanning by the discharging heads and the workpiece.

In the carriage, nozzle lines of the discharging heads are arranged in the sub-scanning direction and end positions of nozzle lines discharging different kinds of liquids are deviated from each other. Thus, it is disclosed that the above arrangement can reduce streaky discharge unevenness in the main-scanning direction due to variation of discharge amount at ends of the nozzle lines.

On the other hand, as a color filter as a functional device, there is proposed a color filter having a filter element with multiple colors (six colors) to improve color reproducibility in JP-A-2005-62833 (a third example of related art).

It can be considered that the color filter production method of the third example of the related art applies the color filter production method of the first example thereof and a structure of the discharging apparatus of the second example thereof. If the carriage includes a plurality of liquid droplet discharging heads capable of discharging the same kind of a liquid, the carriage becomes larger along with an increase in kinds of liquids. Consequently, the liquid droplet discharging apparatus becomes larger.

Meanwhile, when a total number of the discharging heads mounted is equal to that of the kinds of the liquids, the carriage can be made into a smaller size, whereas the liquids are discharged under influence of discharging characteristics inherent to the respective heads. As a result, there occurs a difference of discharge condition among the liquids, which can be recognized as discharge unevenness.

SUMMARY

The present invention has been accomplished to solve at least some of the above problems and is implemented as aspects and features described below.

An advantage of the invention is to provide a liquid droplet discharging apparatus capable of stably discharging a predetermined amount of a liquid in a film formation region in consideration of variation of amounts of droplets discharged from a plurality of nozzles. Another advantage of the invention is to provide a liquid discharging method. A further advantage of the invention is to provide a color filter production method using the discharging apparatus and the liquid discharging method. A still further advantage of the invention is to provide a method for producing an organic EL device by using the liquid discharging method.

A liquid droplet discharging apparatus according to a first aspect of the invention includes a substrate having a plurality of film formation regions; a plurality of nozzles discharging droplets of a liquid, the nozzles being positioned facing the substrate and moved relatively with respect to the substrate to perform a scanning operation so as to discharge the droplets in the film formation regions during the scanning operation; a first moving mechanism moving the substrate relatively with the nozzles in a first direction; a plurality of driving units provided, each corresponding to one of the nozzles; a nozzle driving section generating a plurality of driving signals to supply one of the driving signals changing amounts of the droplets to be discharged to the driving units so as to allow the droplets to be discharged from the nozzles; and a control section controlling the first moving mechanism to allow the scanning operation to be performed a plurality of times over a same film formation region and controlling the nozzle driving section to allow a predetermined amount of the liquid to be discharged as droplets in the same film formation region during the plurality of times of the scanning operations and to change the driving signal applied to the driving units corresponding to nozzles positioned over the film formation region among the nozzles in each of the scanning operations.

In the apparatus of the first aspect, the control section controls the nozzle driving section such that, in each of the scanning operations, different driving signal is supplied to the driving units corresponding to the nozzles positioned over the film formation region during the scanning operations.

Thus, even when same nozzles are positioned again over the film formation region during the scanning operations, different driving signals are supplied to the driving units corresponding to the same nozzles. Thereby, the amounts of droplets to be discharged can be changed.

Accordingly, even if a droplet discharge amount varies among the nozzles when the same driving signal is supplied, the driving signals are made different in each scanning. Thus, the discharging apparatus of the first aspect can ensure that, at a time of completion of discharging of the droplets, a predetermined amount of the liquid is supplied in each of the film formation regions while suppressing variation of the discharge amount.

Preferably, in the liquid droplet discharging apparatus of the first aspect, the nozzles form at least one nozzle line, and the control section controls the nozzle driving section such that the driving signal supplied to the driving units is changed for the at least one nozzle line in each of the scanning operations.

In the discharging apparatus above, the control section controls discharge of droplets on a per-nozzle-line basis. Accordingly, as compared to the discharge control per nozzle, the liquid droplets can be discharged with a simple structure while suppressing the variation of discharge amount among the nozzles.

Preferably, in the liquid droplet discharging apparatus above, the nozzle line includes a plurality of nozzle groups, the nozzle groups being formed by dividing the nozzles according to a total number of the driving signals, and the control section controls the nozzle driving section such that the driving signal supplied to the driving units is changed for each of the nozzle groups in each of the scanning operations.

In the above apparatus, the control section controls discharge of droplets in each nozzle group including the nozzles divided according to the number of the driving signals. Thus, as compared to the discharge control for each nozzle line, a limited number of the driving signals can be used for the nozzle groups to the full extent to suppress variation of the discharge amount among the nozzles, so as to enable an approximately predetermined amount of the liquid to be discharged in each of the film formation regions.

Preferably, in the liquid droplet discharging apparatus above, the nozzle groups are arranged in a second direction orthogonal to the first direction; and the discharging apparatus further includes a second moving mechanism moving the at least one nozzle line in the second direction. In the apparatus, the control section controls the second moving mechanism such that the nozzle line is moved in the second direction during the scanning operations to allow the droplets to be discharged from a different group of the nozzle groups in each of the film formation regions by the scanning operations.

In the above apparatus, in each scanning operation, the nozzle group positioned over the each film formation region is changed and the driving signal supplied to the driving unit corresponding to each nozzle in the nozzle group positioned thereover is also changed. Accordingly, every time the scanning is performed, along with the change of the nozzle group positioned over the film formation group, the discharge amount of droplets is changed among the nozzle groups. Thus, variation of the discharge amount among the nozzles can be further distributed to discharge the liquid in each film formation region.

A liquid discharging method according to a second aspect of the invention includes preparing a substrate having a plurality of film formation regions; allowing a plurality of nozzles to face the substrate; moving the substrate and the nozzles relatively with respect to each other in a first direction to perform a plurality of times of scanning operations; and discharging a predetermined amount of a liquid as droplets from the nozzles during the plurality of times of the scanning operations. When the droplets are discharged, one of a plurality of driving signals changing discharge amounts of the droplets is supplied to a plurality of driving units corresponding to the nozzles, and the driving signal supplied to the driving units is changed, in each of the scanning operations, for the nozzles positioned over each of the film formation regions during the scanning operations among the nozzles.

In the above method, during the plurality of times of the scanning operations, the driving units corresponding to the nozzles positioned over each of the film formation regions receive a driving signal different in each scanning operation.

Thus, even when the same nozzle is positioned again over the film formation region during the plurality of times of the scanning operations, the driving unit corresponding to the same nozzle receives a different driving signal, thereby enabling the discharge amount to be changed.

Accordingly, even if the discharge amount of droplets varies among the nozzles when the same driving signal is supplied, the driving signal is changed in each scanning. Thereby, the liquid discharging method of the second aspect can ensure that, at a time of completion of discharging of the droplets, a predetermined amount of the liquid is supplied in each of the film formation regions while suppressing variation of the discharge amount.

Preferably, in the liquid discharging method of the second aspect, the nozzles form at least one nozzle line, and when discharging the droplets, the driving signal supplied to the driving units is changed for the at least one nozzle line in each of the scanning operations.

In the method of the second aspect, the driving signal is changed on a per-nozzle-line basis in each of the scanning operations. Thus, as compared to the change of the driving signal per nozzle, the liquid droplets can be discharged by a simple structure while suppressing variation of the discharge amount among the nozzles.

Preferably, in the liquid discharging method above, the nozzle line includes a plurality of nozzle groups formed by dividing the nozzles according to a total number of the driving signals, and when discharging the droplets, the driving signal supplied to the driving units is changed for each of the nozzle groups in each of the scanning operations.

In the above method, in each scanning operation, the driving signal is changed for each of the nozzle groups formed according to the number of the driving signals. Thus, as compared to the change of the driving signal per nozzle line, a limited number of the driving signals can be used for the nozzle groups to the full extent to suppress the variation of the discharge amount among the nozzles, so as to discharge an approximately predetermined amount of the liquid in each of the film formation regions.

Preferably, in the liquid discharging method above, when discharging the droplets, the nozzle line is moved in a second direction orthogonal to the first direction during the scanning operations to allow the droplets to be discharged from a different group of the nozzle groups in each of the film formation regions by the scanning operations.

In the liquid discharging method above, every time the scanning operation is performed, the nozzle group positioned over the each film formation region is changed and the driving signal supplied to the driving unit is changed for the nozzle group positioned thereover. Accordingly, in each scanning operation, along with the change of the nozzle group positioned over the film formation region, the amount of droplets discharged is changed for the nozzle group positioned thereover. Thus, the liquid can be discharged in the film formation region by further distributing the variation of the discharge amount among the nozzles.

A method for producing a color filter according to a third aspect of the invention includes discharging a plurality of different colors of liquids each containing a colored layer forming material in a plurality of different film formation regions by using the liquid discharging method of the second aspect of the invention; and solidifying the discharged liquids to form films of a plurality of colored layers each having a different color in the regions.

In the color filter producing method above, at a step of the discharging, a predetermined amount of each of the liquids can be discharged in each film formation region while suppressing variation of the discharge amount. Then, at a step of the film-formation, the colored layer can be formed with an approximately predetermined thickness in each of the film formation regions. Thereby, the method of the third aspect can produce a color filter exhibiting desired optical characteristics in high yields.

According to a fourth aspect of the invention, there is provided a method for producing an organic EL device including an organic EL element with a functional layer including a light emitting layer. The method includes discharging a liquid containing a light emitting layer forming material in a plurality of film formation regions on a substrate by using the liquid discharging method of claim 5; and solidifying the discharged liquid to form a film of the light emitting layer in each of the regions.

In the above method, at the discharging step, a predetermined amount of each color of the liquid can be discharged in each different film formation region while suppressing variation of the discharge amount. Then, at the film-forming step, the light emitting layer can be formed with an approximately predetermined thickness in each of the film formation regions. Thereby, the method of the fourth aspect can produce an organic EL device having desired luminance characteristics in high yields.

BRIEF DESCRIPTION OF THE DRAWINGS

The invention will be described with reference to the accompanying drawings, wherein like numbers reference like elements.

FIGS. 10A and 10B are tables showing various selections of driving signals for nozzle groups.

FIGS. 11A to 11C are schematic diagrams showing methods for performing main scanning a plurality of number of times.

DESCRIPTION OF EXEMPLARY EMBODIMENTS

Embodiments of the invention will be described with reference to the drawings.

First Embodiment

Figure 1:
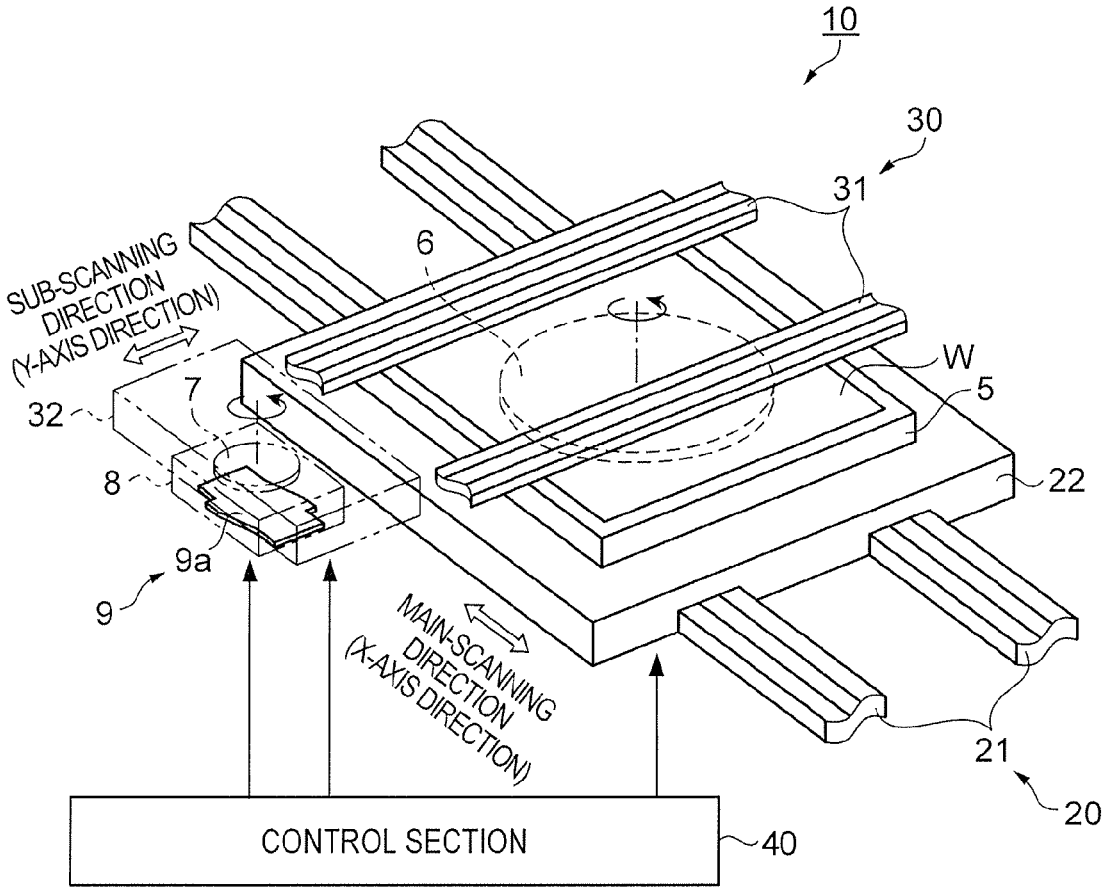
FIG. 1 is a schematic perspective view showing a structure of a liquid droplet discharging apparatus.

First, a description will be given of a liquid droplet discharging apparatus according to a first embodiment of the invention, with reference to FIGS. 1 to 6. FIG. 1 is a schematic perspective view showing a structure of the liquid droplet discharging apparatus.

As shown in FIG. 1, a liquid droplet discharging apparatus 10 of the present embodiment includes a workpiece moving mechanism 20 as a first moving mechanism and a head moving mechanism 30 as a second moving mechanism. The workpiece moving mechanism 20 moves a workpiece W in a main scanning direction as a first direction (an X-axis direction). The head moving mechanism 30 moves a head unit 9 in a sub-scanning direction as a second direction (a Y-axis direction) orthogonal to the main scanning direction.

The workpiece moving mechanism 20 includes a pair of guide rails 21, a moving board 22 moving along the guide rails 21, and a stage 5 for placing the workpiece W disposed via a rotation mechanism 6 on the moving board 22.

The moving board 22 is moved in the main scanning direction by an air slider and a linear motor (not shown) provided inside the guide rails 21. The moving board 22 includes an encoder 12 (see FIG. 5) serving as a timing signal generating section.

Due to relative movement of the moving board 22 in the main scanning direction, the encoder 12 reads a value on a not-shown linear scale disposed on the guide rails 21 to generate an encoder pulse as a timing signal.

The stage 5 can adsorb and fix the workpiece W to a surface of the stage and also can adjust a reference axis inside the workpiece W accurately with respect to the main scanning and the sub-scanning directions by using the rotation mechanism 6. Alternatively, the encoder 12 may be arranged in another manner. For example, when the moving board 22 is configured to move relatively in the X-axis direction along a rotation axis and there is provided a driving section to rotate the rotation axis, the encoder 12 may be included in the driving section. In this case, the driving section is a servomotor or the like.

The head moving mechanism 30 includes a pair of guide rails 31 and a moving board 32 moving along the guide rails 31. The moving board 32 includes a carriage 8 suspended by a rotation mechanism 7.

The carriage 8 includes the head unit 9 with a plurality of liquid droplet discharging heads 50 (see FIG. 2).

Figure 5:
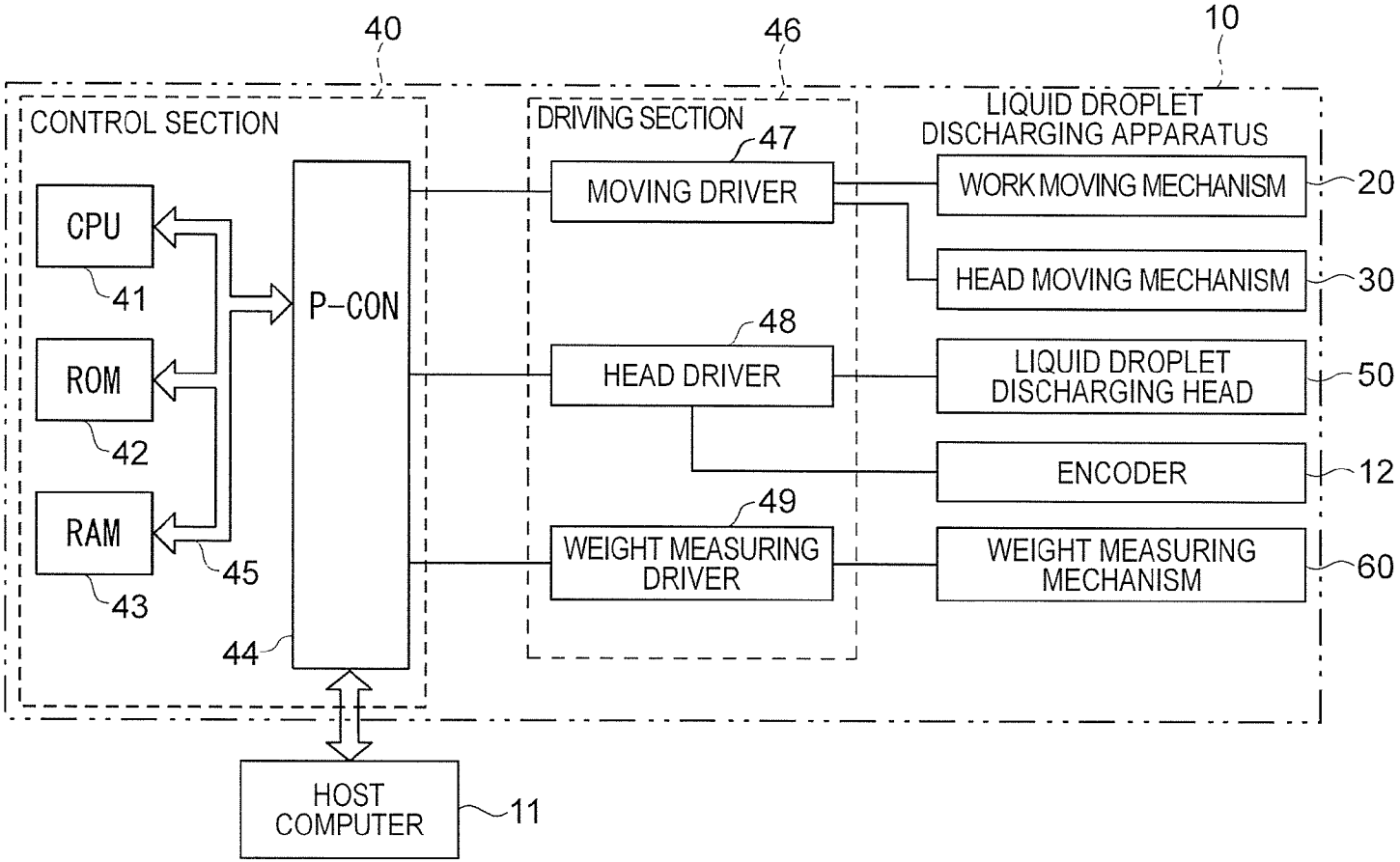
FIG. 5 is a block diagram showing a control system of the liquid droplet discharging apparatus.

Additionally, there are provided a liquid supplying mechanism (not shown) and a head driver 48 (see FIG. 5). The liquid supplying mechanism supplies a liquid to the liquid droplet discharging heads 50, and the head driver 48 electrically controls driving of the liquid droplet discharging heads 50.

The moving board 32 moves the carriage 8 in the Y-axis direction to allow the head unit 9 to face the workpiece W.

In addition to the components described above, the liquid droplet discharging apparatus 10 includes a maintenance mechanism that performs maintenance tasks such as elimination of nozzle clogging in the liquid droplet discharging heads mounted on the head unit 9, removal of a foreign substance or a stain on a nozzle surface, and the like. The maintenance mechanism is disposed in a position facing the liquid droplet discharging heads 50.

The liquid droplet discharging apparatus 10 also includes a weight measuring mechanism 60 (see FIG. 5). The weight measuring mechanism has a measuring instrument (such as an electronic balance) to receive the liquid discharged from each of the discharging heads 50 and measure a weight of the liquid. Furthermore, the discharging apparatus 10 includes a control section 40 to generally control an entire structure including all of the above components.

FIG. 1 shows neither the maintenance mechanism nor the weight measuring mechanism 60.

Figure 2A:
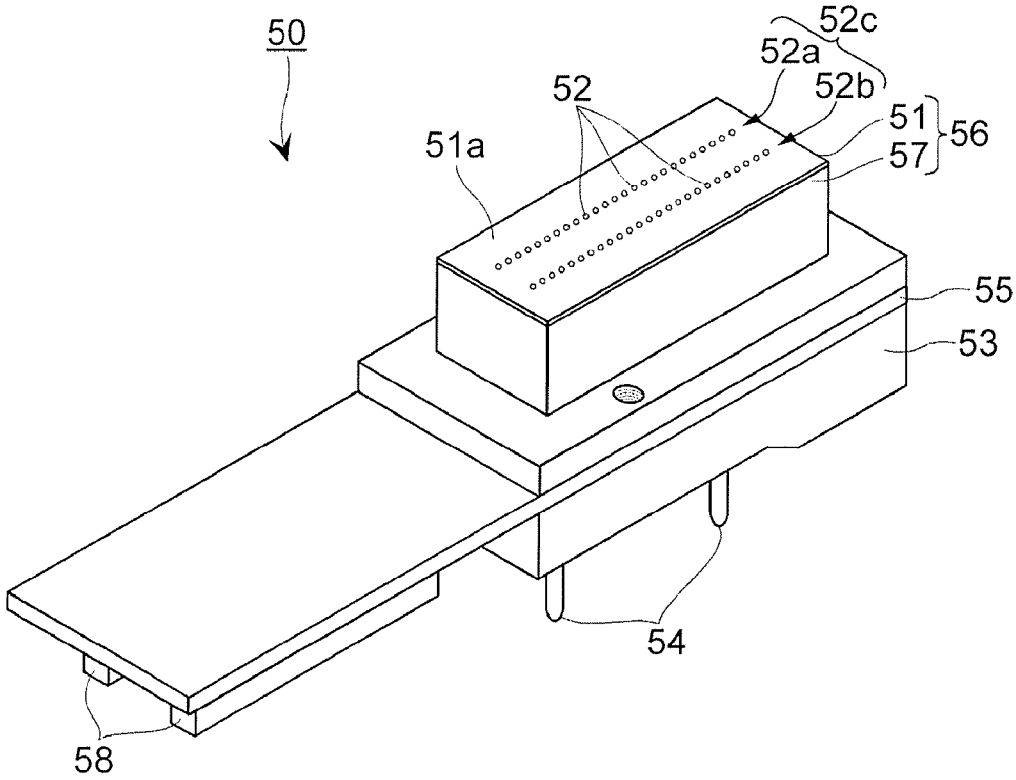
FIG. 2A is a perspective view showing a single liquid droplet discharging head.
Figure 2B:
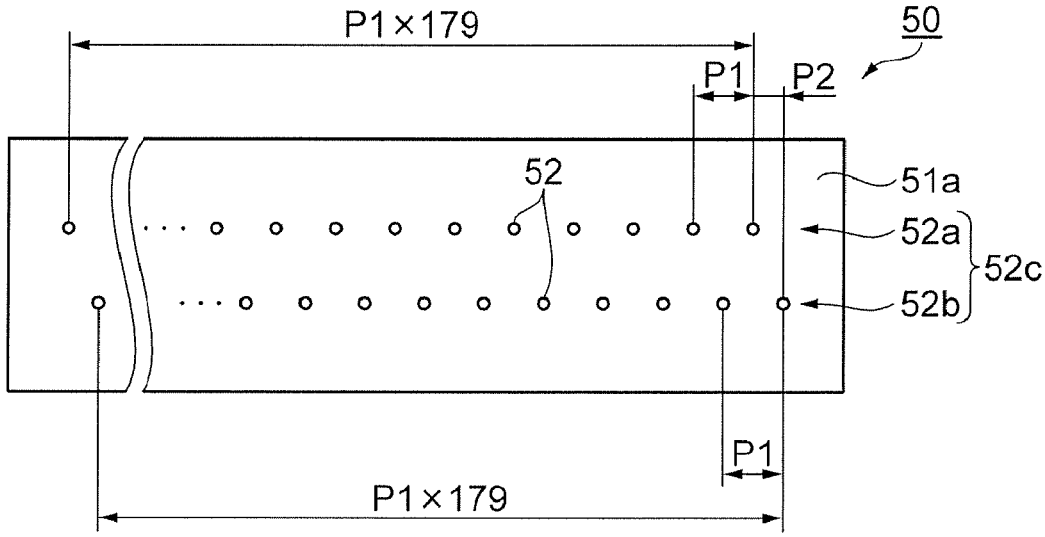
FIG. 2B is a plan view showing an arrangement of nozzles.

FIG. 2A is a schematic perspective view showing a structure of one of the liquid droplet discharging heads 50 and FIG. 2B is a plan view showing an arrangement of nozzles included in the discharging head 50.

As shown in FIG. 2A, the liquid droplet discharging heads 50 of the discharging apparatus 10 have a so-called twin structure. Each of the discharging head 50 includes a liquid guiding section 53 having twin connecting needles 54, a head substrate 55 laminated on the liquid guiding section 53, and a head main body 56 arranged on the head substrate 55. The head main body 56 has an intrahead flow channel for the liquid inside the body. The connecting needles 54 are connected to the not-shown liquid supplying mechanism via piping to supply the liquid to the intrahead flow channel. The head substrate 55 includes twin connectors 58 connected to the head driver 48 (see FIG. 5) via a not-shown flexible flat cable.

The head main body 56 includes a pressure applying section 57 and a nozzle plate 51. The pressure applying section 57 includes piezoelectric elements each serving as a driving unit and cavities. The nozzle plate 51 has a nozzle surface 51*a* on which two nozzle lines 52*a* and 52*b* are formed in parallel to each other.

As shown in FIG. 2B, in each of the two nozzles lines 52*a* and 52*b*, a plurality of nozzles 52 (180 nozzles in the present embodiment) are spaced apart from each other with an approximately equal distance, by a pitch P1. In this case, the nozzle lines 52*a* and 52*b* are disposed on the nozzle plate 51 so as to be deviated from each other by a pitch P2 that is a half of the pitch P1. In the embodiment, the pitch P1 is approximately 141 μm. Thus, when viewed from a direction orthogonal to a nozzle line 52*c* (including both the nozzle lines 52*a* and 52*b*), 360 nozzles 52 are arranged at a nozzle pitch of approximately 70.5 μm. The nozzles 52 each have a diameter of approximately 27 μm.

When the head driver 48 supplies a driving signal as an electric signal to each piezoelectric element, a volume of each cavity in the pressure applying section 57 is changed. This creates a pumping action to apply pressure to the liquid filled in the cavity, thereby allowing each of the liquid droplet discharging heads 50 to discharge a droplet of the liquid from each nozzle 52.

As an alternative to the piezoelectric element, the driving unit used in the liquid droplet discharging head 50 may be an electro-mechanical transducer causing a vibration plate as an actuator to be displaced by static adsorption or an electro-thermal transducer (a thermal system) heating the liquid and then discharging droplets of the heated liquid from the nozzles 52.

Figure 3:
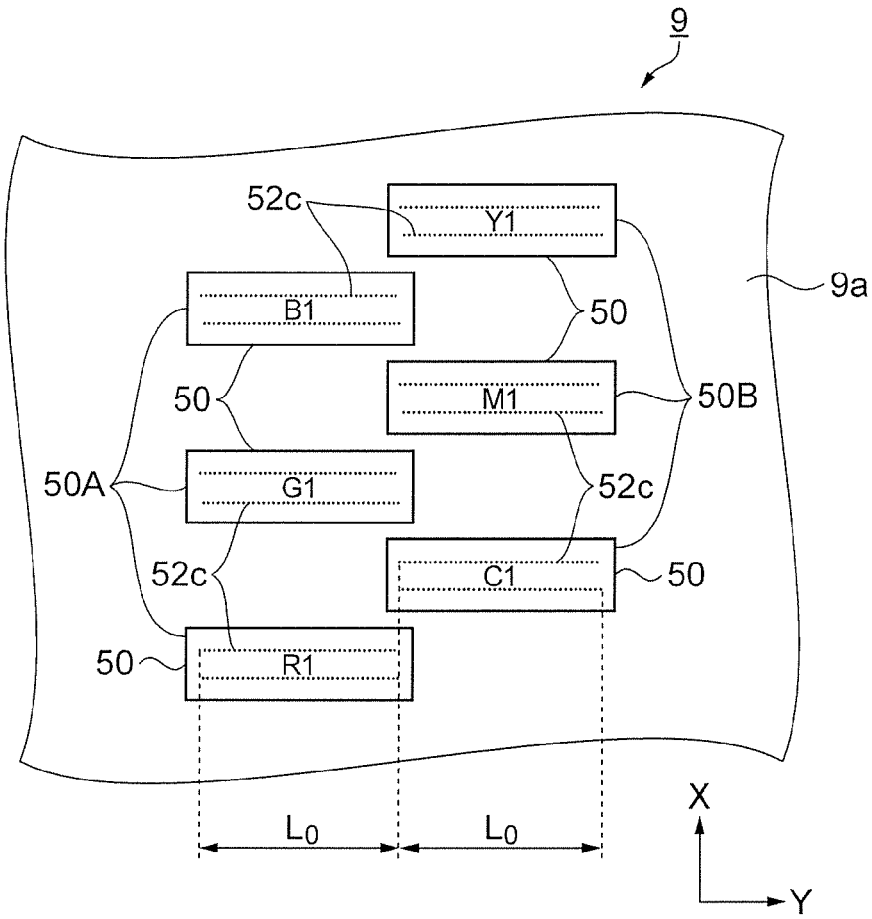
FIG. 3 is a schematic plan view showing an arrangement of a plurality of liquid droplet discharging heads included in a head unit.

FIG. 3 is a schematic plan view showing an arrangement of the liquid droplet discharging heads 50 included in the head unit 9, and specifically, a plan view of a surface of the head unit facing the workpiece W.

As shown in FIG. 3, the head unit 9 includes a head plate 9*a* having the liquid droplet discharging heads 50 on the plate. The head plate 9*a* includes a total six liquid droplet discharging heads 50 composed of a head group 50A and a head group 50B. In each of the head groups 50A and 50B, three liquid droplet discharging heads 50 are arranged in parallel to one another in the main scanning direction. The head group 50A includes heads R1, G1, and B1, and the head group 50B includes heads C1, M1, and Y1. Those heads discharge different kinds of liquids from each other, thus enabling six different kinds of liquids to be discharged.

A drawing width Lo represents a width of drawing by a single liquid droplet discharging head 50 and is set as an effective length of the nozzle line 52*c*. Hereinafter, the nozzle line 52*c* is referred to as a line including the 360 nozzles 52.

In this case, the heads R1 and C1 are arranged in parallel to each other in the main scanning direction such that the nozzle lines 52*c* of the heads R1 and C1 adjacent to each other when viewed from the main scanning direction (the X-axis direction) continue via a single nozzle pitch in the sub scanning direction (the Y-axis direction) orthogonal to the main scanning direction. The two heads G1, M1 and the two heads B1, Y1, respectively, are arranged in parallel in the main direction in the same manner as in the heads R1 and C1.

An arrangement of the liquid droplet discharging heads 50 in the head unit 9 is not restricted to that described above. For example, among them, three discharging heads 50 (the heads R1, G1, and B1) may be arranged linearly in the sub-scanning direction (the Y-axis direction), and remaining three discharging heads 50 (the heads C1, M1, and Y1) may be arranged such that the heads C1, M1, and Y1 are in parallel to the R1, G1, and B1 in the main scanning direction (the X-axis direction). In addition, the nozzle line 52*c* included in each of the discharging heads 50 may not be composed of the double lines but may be composed of a single line.

Figure 4:
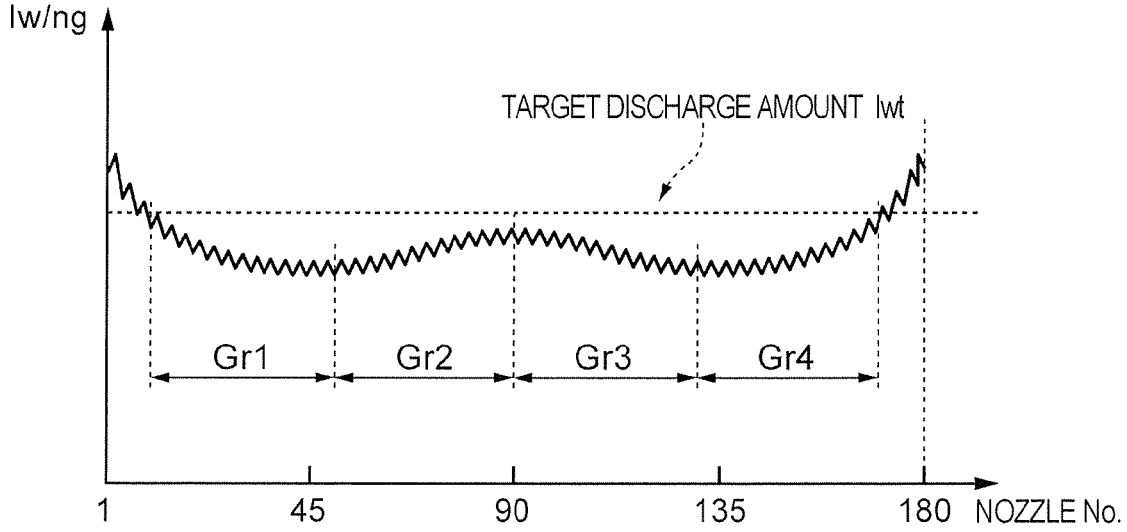
FIG. 4 is a graph showing discharging characteristics of the liquid droplet discharging head.

FIG. 4 is a graph sowing discharging characteristics of the liquid droplet discharging head. Specifically, one of axes in the graph represents numbers (Nos.) of the nozzles 52, while the other axis represents an amount (Iw/ng) of a liquid droplet discharged from each of the nozzles 52. Thereby, the graph shows a distribution of the discharge amount in the nozzle line 52*a*.

Even when a same driving signal is supplied to the piezoelectric elements 59 provided for the respective nozzles 52 to discharge liquid droplets, the amounts of droplets discharged from the nozzles 52 are shown to vary among the nozzles due to variation of inherent electric characteristics in the piezoelectric elements 59, a design difference in the intrahead flow channels such as the cavities communicating with the respective nozzles 52, and the like. Particularly, an electrical/mechanical crosstalk between the nozzles is an important factor associated with the variation of the discharge amount. In other words, the distribution of the amounts of liquid droplets discharged from the nozzles 52 are different depending on the nozzle lines 52*a* and 52*b* or the liquid droplet discharging heads 50.

FIG. 4 shows discharging characteristics of the liquid droplet discharging head 50 (the nozzle line 52*a*). Specifically, a driving signal having a predetermined driving voltage is supplied to the piezoelectric elements 59 to discharge approximately a few thousands to a few ten thousands of liquid droplets from the nozzles 52. In this case, a total number of the discharged droplets are equal to a total number of times of discharge. Then, using the weight measuring mechanism 60 (see FIG. 5), a weight of the discharged liquid is measured and divided by the number of times of discharge to calculate a weight per droplet, thereby obtaining a droplet discharge amount Iw of each nozzle.

As shown in FIG. 4, the obtained droplet discharge amounts Iw of the nozzles 52 exhibit a curve referred to as an "Iw arch". Among the nozzles 52, nozzles located at opposite ends of the nozzle line 52*a* tend to have a larger droplet discharge amount Iw than the other nozzles 52.

The embodiment describes the droplet discharge amount Iw based on the weight of the droplets. However, alternatively, volumes of droplets discharged may be measured to obtain variation of the discharge amount among the nozzles 52.

For one characteristic, the liquid droplet discharging apparatus 10 of the embodiment controls discharge of droplets in consideration of the Iw arch as above. The nozzle line 52*a* (the nozzle line 52*b*) is divided into a plurality of nozzle groups (four nozzle groups in the embodiment) according to the number of driving signals described below. Specifically, in the nozzle line 52*a* (the nozzle line 52*b*) composed of 180 nozzles 52, 160 nozzles 52, except for respective ten nozzles that are located at the opposite ends and that tend to be outside a range of a target discharge amount Iwt, are referred to as working nozzles. The working nozzles are divided into the plurality of (four) nozzle groups Gr, namely, nozzle groups Gr 1, Gr 2, Gr 3, and Gr 4. Discharge control of the nozzle groups Gr will be described in detail later.

Next will be described a control system of the liquid droplet discharging apparatus 10. FIG. 5 is a block diagram showing the control system of the discharging apparatus 10. As shown in the drawing, the control system of the discharging apparatus 10 includes a driving section 46 having various drivers that drive the liquid droplet discharging heads 50, the work moving mechanism 20, the head moving mechanism 30, the weight measuring mechanism 60, and the like and the control section 40 generally controlling the discharging apparatus 10 as a whole, including the driving section 46.

The driving section 46 includes a moving driver 47 controlling driving of respective linear motors included in the work moving mechanism 20 and the head moving mechanism 30, a head driver 48 as a nozzle driving section controlling discharging operation by the liquid droplet discharging heads 50, and a weight measuring driver 49 controlling driving of the weight measuring mechanism 60. In addition, the driving section 46 includes a maintenance driver controlling driving of the maintenance mechanism, and the like, although not shown in the drawing.

The control section 40 includes a CPU 41, a ROM 42, a RAM 43, and a P-CON 44 that are connected to each other via a bus 45. The P-CON 44 is connected to a host computer 11. The ROM 42 has a control program region for storing a control program and the like processed by the CPU 41 and a control data region for storing control data used to perform drawing operation, function recovery processing, and the like.

The RAM 43 has various storage sections such as a drawing data storage section storing drawing data for performing drawing on the workpiece W and a position data storage section storing position data of the workpiece W and the liquid droplet discharging heads 50 (actually, the nozzle lines 52*a* and 52*b*). The RAM 43 is used as a region for various jobs in control processing. The P-CON 44, which is connected to the drivers of the driving section 46, incorporates logic circuits complementing the CPU 44's function and treating interface signals from and to adjacent circuits. The P-CON 44 thus takes commands or the like from the host computer 11 into the bus 45, either without or with processing, as well as outputs data or a control signal output to the bus 45 by the CPU 41 or the like to the driving section 46, either without or with processing, in conjunction with the CPU 41.

According to the control program stored in the ROM 42, the CPU 41 inputs various detecting signals, commands, data, and the like to the driving section 46 or the like via the P-CON 44 and processes the variety of data and the like stored in the RAM 43. After that, the CPU 41 outputs control signals to the driving section 46 or the like via the P-CON 44 to generally control the liquid droplet discharging apparatus 10. For example, the CPU 41 controls the liquid droplet discharging heads 50, the work moving mechanism 20, and the head moving mechanism 30 to allow the head unit 9 and the workpiece W to face with each other. Next, in sync with relative movement between the head unit 9 and the workpiece W, the CPU 41 outputs a control signal to the head driver 48 to allow the respective liquid droplet discharging heads 50 in the head unit 9 to discharge liquid droplets from the nozzles 52 on the workpiece W. In this case, discharging the liquid droplets in sync with movement of the workpiece W in the X-axis direction is referred to as "main scanning", whereas moving the head unit 9 in the Y-axis direction is referred to as "sub-scanning". The liquid droplet discharging apparatus 10 of the present embodiment repeats a combination of main scanning and sub-scanning a plurality of times to discharge the liquid for drawing. The main scanning is not restricted to the one-way relative movement of the workpiece W with respect to the liquid droplet discharging heads 50, and the main scanning may be performed by reciprocating movement of the workpiece W.

The encoder 12 is electrically connected to the head driver 48 and generates an encoder pulse due to the main scanning. Upon the main scanning, the moving board 22 is moved at a predetermined speed, whereby the encoder 12 cyclically generates the encoder pulse.

The host computer 11 transmits control information such as the control program and the control data to the liquid droplet discharging apparatus 10. In addition, the host computer 11 serves as an arrangement information generating section to generate arrangement information, namely, discharge control data necessary to arrange a predetermined amount of liquid droplets in each film formation region on a substrate. The arrangement information is represented, for example, using a bit map of pieces of information regarding positions of droplets discharged in the each film formation region (a position of the workpiece W with respect to the nozzles 52), the number of droplets arranged in the each film formation region (the number of times of discharge from each nozzle 52), ON/OFF of the nozzles 52 during the main scanning (selection patterns of the nozzles 52), discharging timing, and the like. The host computer 11 can not only generate the arrangement information but also can correct the arrangement information once stored in the RAM 43.

Figure 6:
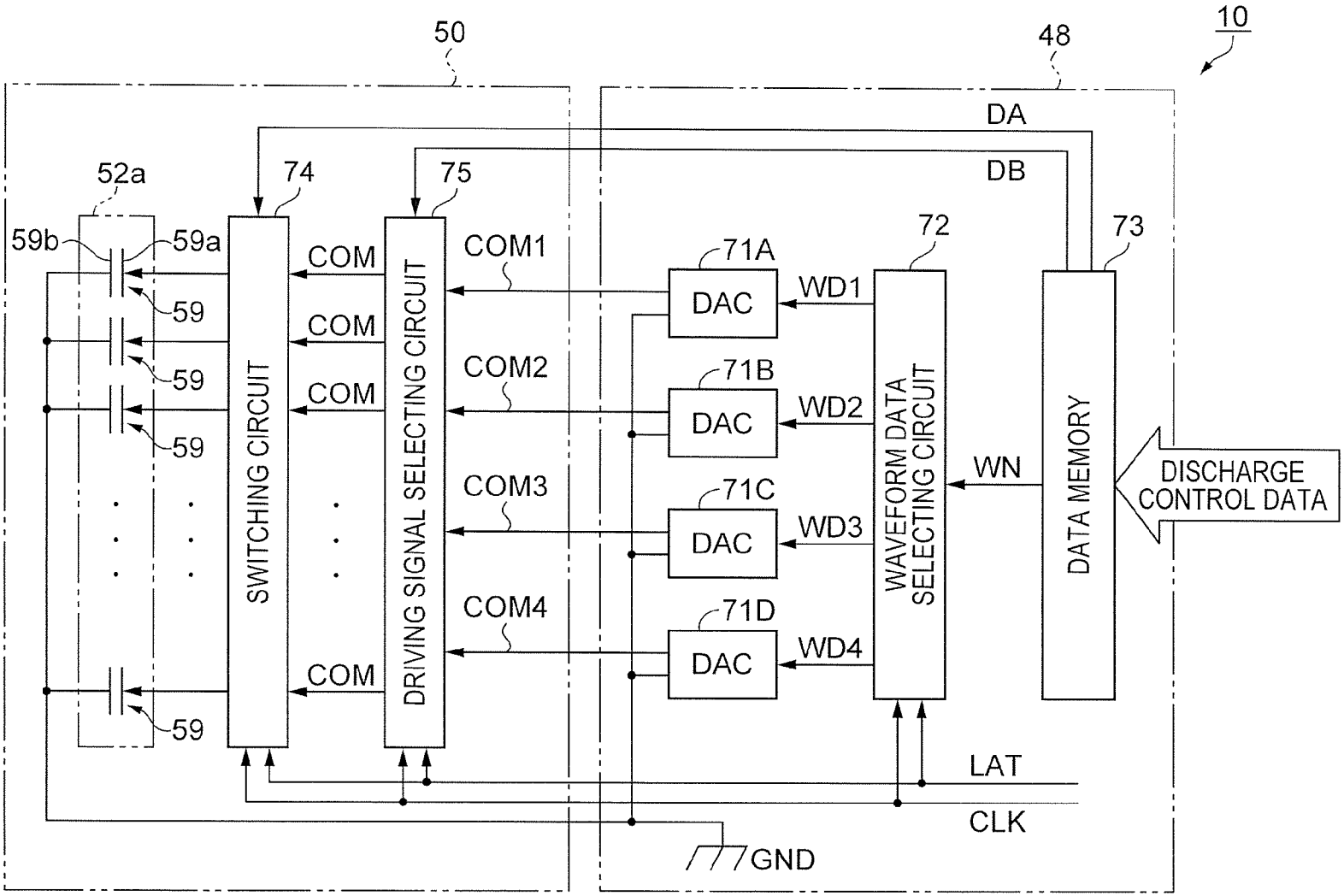
FIG. 6 is a block diagram showing an electrical control of the liquid droplet discharging head.
Figure 7:
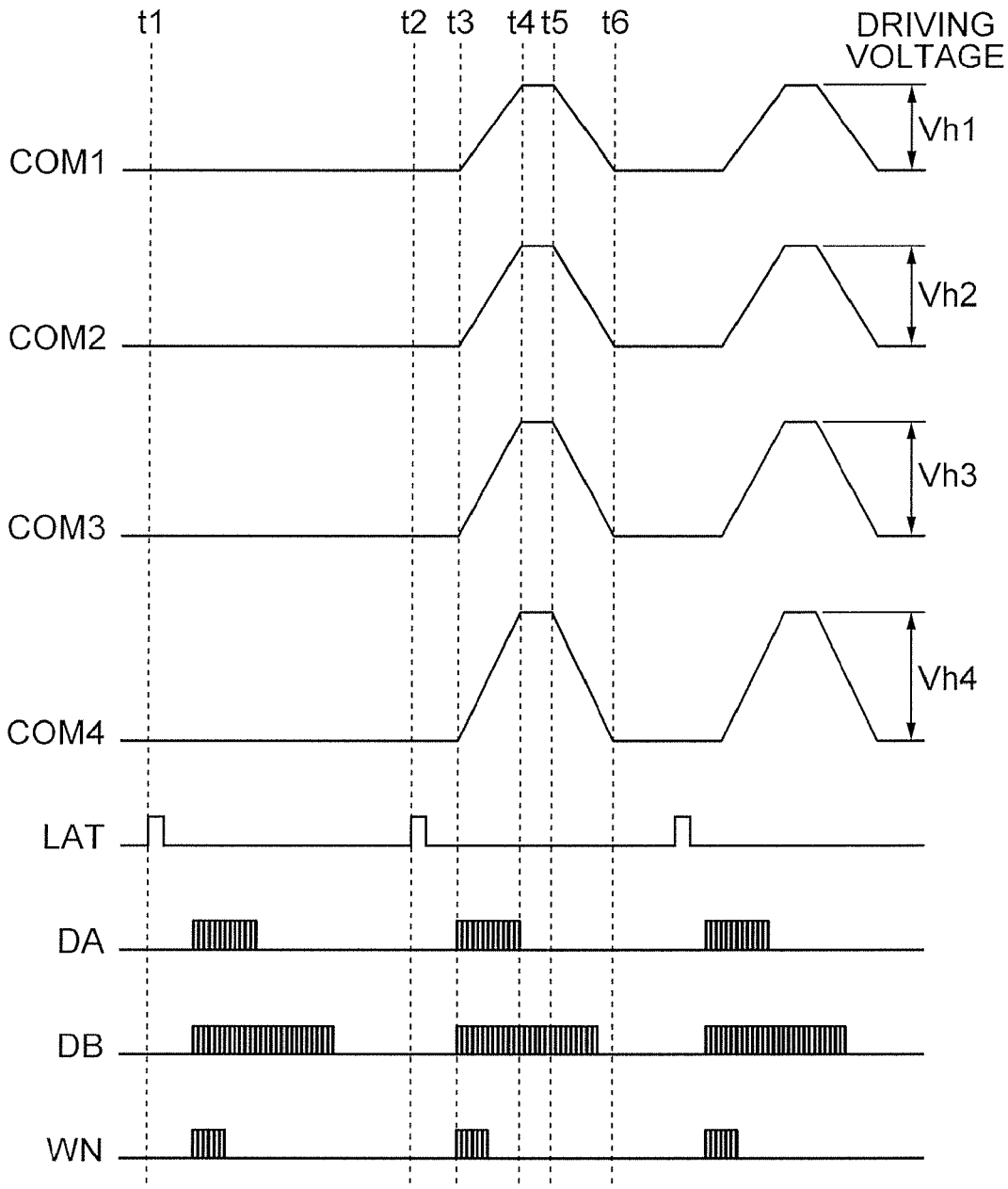
FIG. 7 is a timing chart of driving signals and control signals.

Method for Controlling Discharging Droplets from Liquid Droplet Discharging Heads Next, with reference to FIGS. 6 and 7, a description will be given of a method for controlling discharging droplets from the liquid droplet discharging heads of the embodiment. FIG. 6 is a block diagram showing electrical control of the discharging head 50, and FIG. 7 is a timing chart of driving signals and control signals.

As shown in FIG. 6, the head driver 48 includes D/A converters (hereinafter referred to as "DACs") 71A to 71D, a waveform data selecting circuit 72, and a data memory 73. The DACs respectively and independently generate a plurality of driving signals COM, respectively, to control the amounts of liquid droplets discharged. The waveform data selecting circuit 72 incorporates a storage memory for slew rate data of the respective driving signals COM generated by the DACs 71A to 71D (hereinafter referred to as "waveform data WD1 to WD4"). The data memory 73 stores discharge control data transmitted from the host computer 11 via the P-CON 44. The driving signals COM generated by the DAC 71A to 71D are output to respective COM lines: COM-1 to COM-4.

Each liquid droplet discharging head 50 includes a switching circuit 74 and a driving signal selecting circuit 75. The switching circuit 74 turns on or off supply of the driving signals COM to the piezoelectric elements 59 provided corresponding to the respective nozzles 52. The driving signal selecting circuit 75 selects one of the COM lines to transmit the driving signals COM to the switching circuit 74 connected to the piezoelectric elements 59.

In the nozzle line 52*a*, a second electrode 59*b* of the each piezoelectric element 59 is connected to a ground line (GND) of the DACs 71A to 71D, whereas a first electrode 59*a* (hereinafter referred to as "segment electrode 59*a*") thereof is electrically connected to each COM line via the switching circuit 74 and the driving signal selecting circuit 75. In addition, the switching circuit 74, the driving signal selecting circuit 75, and the waveform data selecting circuit 72 receive a clock signal (CLK) and a latch signal (LAT) corresponding to each discharging timing. The nozzle line 52*b* has the same electrical connection as in the nozzle line 52*a*, although not shown in the drawing.

The data memory 73 stores following data at every discharging timing point cyclically set according to a scanning position of each liquid droplet discharging head 50. The data include discharge data DA for determining supply (ON/OFF) of the driving signals COM to the respective piezoelectric elements 59, driving signal selecting data DB for determining selection of the COM lines (the COM-1 to the COM-4) corresponding to the piezoelectric elements 59, and waveform-number data WN for determining kinds of the waveform data (the WD-1 to WD-4) input to the DACs 71A to 71D. In the embodiment, the discharge data DA, the driving signal selecting data DB, and the waveform-number data WN, respectively, are composed of 1 bit (0, 1) per nozzle, 2 bits (0, 1, 2, 3) per nozzle, and 7 bits (0 to 127) per D/A converter, respectively. Data structure can be changed according to needs.

In the above arrangement, driving control at each discharging timing point will be provided as follows. As shown in FIG. 7, during a period from timing t1 to timing t2, the discharge data DA, the driving signal selecting data DB, and the waveform-number data WN, respectively, are converted into serial signals to be transmitted to the switching circuit 74, the driving signal selecting circuit 75, and the waveform data selecting circuit 72, respectively. When the respective data is latched at timing t2, the segment electrode 59*a* of each piezoelectric element 59 relating to discharge (ON) becomes connected to a COM line designated by the driving signal selecting data DB, namely, to any one of the COM-1 to the COM-4. For example, when the driving signal selecting data DB is "0", the segment electrode 59*a* of the piezoelectric element 59 is connected to the COM-1. Similarly, when the driving signal selecting data DB is "1", "2", and "3", respectively, the segment electrode 59*a* is connected to the COM-2, the COM-3, and the COM-4, respectively. In addition, the waveform data WD-1 to WD-4 of the driving signals relating to generation of the DAC 71A to the DAC 71D are determined in conjunction with the above selection of the COM lines.

During a period from timing t3 to timing t4, based on the waveform data set at timing t2, the driving signals COM are generated through a series of steps including increase, retention, and drop of potential. Then, the driving signals COM generated are supplied to the piezoelectric elements 59 connected to the COM-1 to the COM-4 to control the volumes (pressures) of the cavities of the pressure-applying section 57 communicating with the nozzles 52.

A potential increasing component at timing t3 expands the cavities in the pressure applying section 57 to allow the liquid to flow into the cavities. In addition, a potential dropping component at timing t4 causes the cavities to contract, thereby allowing the liquid to be pushed out and discharged from the nozzles 52.

Time and voltage components associated with the increase, retention, and drop of potential in the driving signals COM depend closely on the amount of the liquid discharged by supplying the driving signals COM. Particularly, in each of the piezoelectric liquid droplet discharging heads 50, the discharge amount shows a favorable linearity against voltage component changes. Thus, a voltage component change (a potential difference) during the period from timing t3 to timing t4 can be defined as a driving voltage Vh to be used as a condition for controlling the discharge amount. The generated driving signals COM are not restricted to those having simple rectangular waveform characteristics as shown in the embodiment. For example, the driving signals COM may have waveforms of another known shape such as a trapezoidal shape according to needs. In a case of an embodiment using a different driving system (such as a thermal system), a pulse width (a time component) of each of the driving signals may be used as the condition for controlling the discharge amount.

The present embodiment prepares a plurality of kinds of waveform data having the driving voltage Vh varying in stages. The independent waveform data WD-1 to WD-4, respectively are input to the DAC 71A to 71D, respectively, whereby the driving signals COM having driving voltages Vh-1 to Vh-4 different from each other can be output to the respective COM lines. In the embodiment, there can be prepared 128 kinds of waveform data corresponding to the amount of information (7 bits) of the waveform-number data WN. For example, the 128 kinds of waveform data correspond to the driving voltages Vh set in increments of 0.1V. In other words, respective driving waveforms of the driving voltages Vh- to Vh-4 can be set in increments of 0.1V in a potential difference up to 12.8V.

Accordingly, in consideration of the variation among the droplet discharge amounts Iw from the nozzles 52, the liquid droplet discharging apparatus 10 can appropriately set the driving signal selecting data DB defining a relationship between the piezoelectric elements 59 (the nozzles 59) and the respective COM lines and the waveform-number data WN defining a relationship between the respective COM lines and the kinds of the driving signals (the driving voltages Vh) to adjust the droplet discharge amount Iw so as to discharge the liquid. Therefore, in order to control the discharge amount Iw, it is surely important to appropriately select the driving signals COM for the respective nozzles 52 determined by the relationship between the driving signal selecting data DB and the waveform-number data WN. Hereinafter, in terms of the relationship between the COM lines and the driving signals, the driving signals COM corresponding to the respective waveform data WD-1 to WD-4 will be referred to as "driving signals COM-1 to COM-4" for convenience in the description.

In the liquid droplet discharging apparatus 10 of the embodiment, the driving signal COM supplied to the piezoelectric element 59 of the each nozzle 52 discharging a droplet is different in each main scanning operation performed by the liquid droplet discharging heads 50 and the workpiece W. That is, every time the main scanning operation is performed, any one of the driving signals COM-1 to COM-4 is selected and supplied to the piezoelectric elements 59 corresponding to selected nozzles 52.

The above discharge control can be performed for the nozzle line 52*a* (the nozzle line 52*b*) composed of the working 160 nozzles 52 or for the nozzle line 52*c* including the 320 nozzles 52 of the nozzle lines 52*a* and 52*b*.

Furthermore, the discharge amount can be controlled for each of the nozzle groups Gr formed by dividing the nozzles according to a total number of the waveform data, namely, a total number of the driving signals COM.

Thereby, the amount Iw of liquid droplets discharged from each nozzle 52 can be changed over at least four stages in each main scanning operation. Thus, as compared to when a predetermined driving signal COM is supplied to each piezoelectric element 59, variation of the droplet discharge amount Iw caused by discharging characteristics of the nozzles 52 can be adjusted for each nozzle 52, for each nozzle line 52*a* (each nozzle line 52*b*), for each nozzle group Gr, or for each nozzle line 52*c* discharging different colors of liquids (namely, each liquid droplet discharging head 50). Consequently, the liquid droplets can be discharged while reducing the discharge variation due to the discharging characteristics of the nozzles 52.

Liquid Discharging Method and Color Filter Producing Method

Next will be described a liquid discharging method according to an embodiment of the invention by exemplifying an example of a color filter producing method using the liquid discharging method.

Figure 8A:
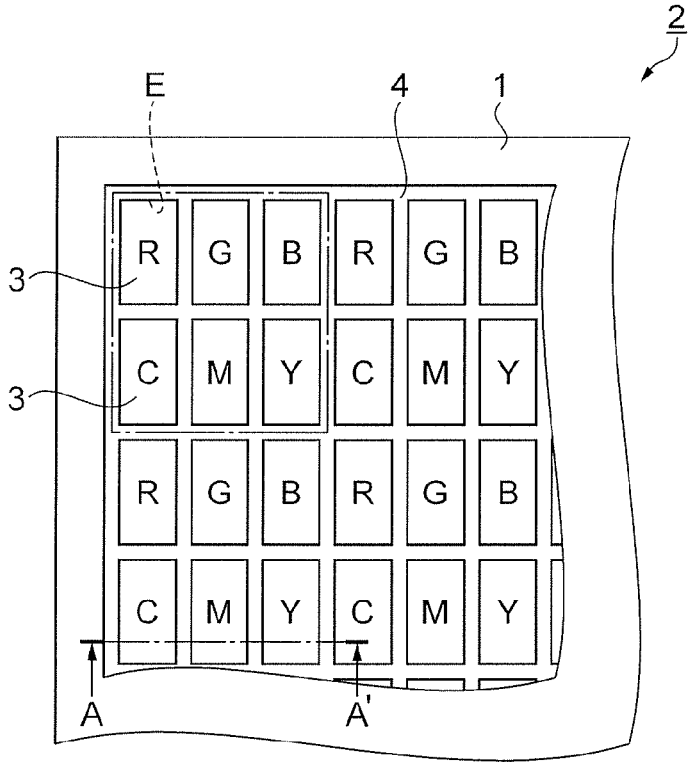
FIG. 8A is a schematic plan view showing a structure of a color filter.

First, a description will be given of a color filter according to an embodiment of the invention. FIG. 8A is a schematic plan view showing the color filter, and FIG. 8B is a sectional view taken along line A-A' of FIG. 8A.

As shown in FIG. 8A, a color filter 2 of the embodiment includes a plurality of colored layers 3 having mutually different colors (six different colors in the drawing) provided in a plurality of different film formation regions E formed by a partition wall 4 on a substrate 1. Specifically, the color filter 2 includes the colored layers 3 of six different colors, namely, the three primary colors: red (R), green (G), and blue (B), as well as cyan (C), magenta (M), and yellow (Y). Each of the film formation regions E has an approximately rectangular shape and is formed into a matrix by the partition wall 4. The color filter 2 is of a so-called stripe pattern where the colored layers 3 having a same color are arranged in each same column. The shape of the film formation region E is not restricted to the rectangular one.

When using the color filter 2 formed as above in a display, the colored layers 3 of the respective colors are arranged in a manner corresponding to respective pixels. A single picture element includes six pixels of R, G, B, C, M, and Y, thereby improving color reproducibility more than in an arrangement of the three primary colors only.

Figure 8B:
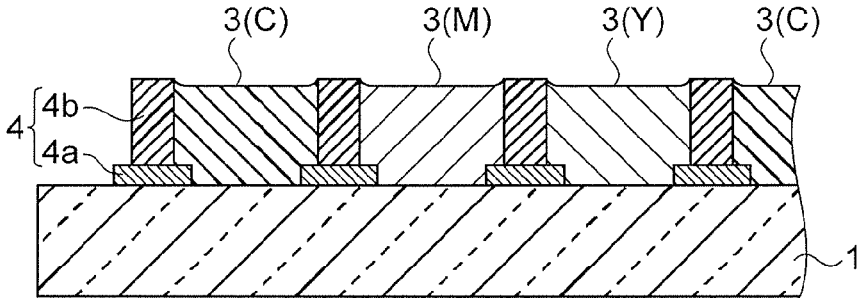
FIG. 8B is a sectional view taken along line A-A of FIG. 8A.

As shown in FIG. 8B, the substrate 1 is made of, for example, a transparent base material such as glass.

The partition wall 4 has a so-called two-layer bank structure composed of a first partition wall 4*a* and a second partition wall 4*b* formed on the first partition wall 4*a*.

The first partition wall 4*a* is a thin film made of a light shielding metal or metal compound, such as an Al or Cr thin film or an oxide film of Al or Cr, for example. The first partition wall 4*a* has a thickness of approximately 0.1 μm exhibiting light shielding properties. The first partition wall 4*a* is generally called as a black matrix (BM).

For example, the second partition wall 4*b* is made of a cured acryl or polyimide photosensitive resin material and has a height (a film thickness) of approximately 1.5 to 2.0 μm, although the thickness of the second partition wall 4*b* depends on conditions for forming films of the colored layers 3 to be formed in the film formation regions E. In the partition wall 4, when the second partition wall 4*b* is made of a light shielding material, the first partition wall 4*a* can be omitted.

Each of the colored layers 3 is made of a translucent resin material containing a color material of each color. The color material may be a well-known pigment or dye, for example. In the embodiment, the liquid droplet discharging apparatus 10 discharges each of six kinds (six colors) of liquids containing the colored-layer forming material in each different one of the film formation regions E to form films of the respective colored layers 3.

The film thickness of the colored layers 3 needs to be even only among the colored layers 3 of the same color, although, preferably, the colored layers 3 of all the colors have an even thickness. This can reduce surface unevenness of the substrate 1 after formation of the colored layers 3. In other words, the color filter 2 can obtain desired optical characteristics and can have a further flattened planar shape.

A method for producing the color filter 2 according to the embodiment includes forming the partition wall on the substrate 1, performing surface-treatment of the partition wall 4 and the film formation region E, discharging droplets of the six different kinds (the six different colors) of liquids containing the colored-layer forming material in a plurality of film formation regions E formed by the partition wall 4, and drying the liquid droplets discharged to remove residual solvent to form films of the colored layers 3 having the six different colors.

At a step of forming the partition wall, first, a thin film made of a metal or a metal compound is formed on a surface of the substrate 1, and patterning is performed by photolithography to form the first partition wall 4*a* having a lattice shape. Then, a photosensitive resin material is applied to form a photosensitive resin layer, on which a lattice patterning is similarly performed by photolithography to form the second partition wall 4*b* on the first partition wall 4*a*. As described above, when the second partition wall 4*b* has light shielding properties, the first partition wall 4*a* is not necessary.

Other than the above method, the partition wall 4 may be formed, for example, by printing methods such as offset printing or a transcription method transcribing the partition wall 4 pre-formed on another base member.

Next, at a step of performing the surface treatment, the surface of the substrate 1 having the partition wall 4 is subjected to the surface-treatment. Specifically, a surface of the second partition wall 4*b* made of the organic material is plasma-treated with a fluorine gas (such as $CF_4$) to provide lyophobic properties. In addition, a plasma treatment using an oxygen gas is performed on the film formation regions E to make the regions lyophilic. Thereby, at a following step of discharging the liquid droplets, discharged droplets can be taken into the film formation regions E even if the droplets land on the partition wall 4. Additionally, droplets landing on the film formation regions E spread evenly on the regions.

At the liquid droplet discharging step, the six colors of the liquids are discharged in the film formation regions E of the substrate 1 by the liquid droplet discharging apparatus 10. Thus, the discharging step uses the arrangement of the head unit 9 shown in FIG. 3. The head unit 9 includes the droplet discharging heads 50 capable of discharging the liquids, where each discharging head corresponds to each color.

In the present embodiment, the substrate 1 is mounted on the stage 5 to determine positioning in such a manner that the reference axis of the substrate 1 is adjusted with respect to axes X and Y. Then, the stage 5 is moved relatively with respect to the head unit 9 having the liquid droplet discharging heads 50 in the main scanning direction (the X-axis direction) to perform a plurality of times of main scanning operations. During the main scanning operations, the liquid droplet discharging heads 50 discharge droplets of the liquids on desired film formation regions E.

Figure 9A:
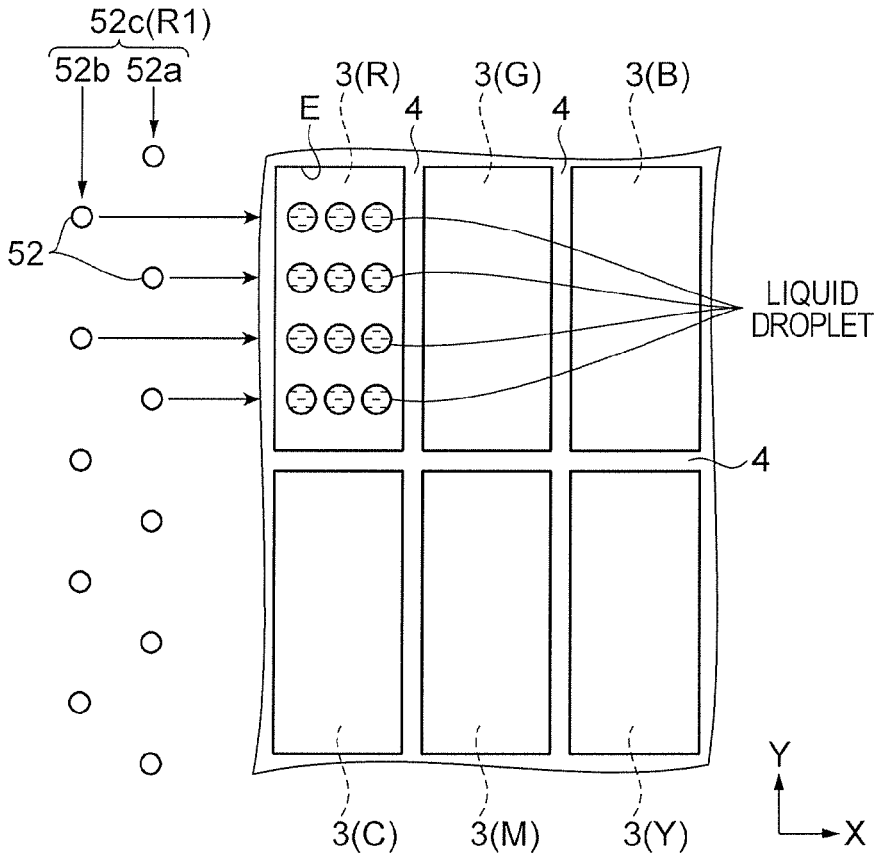
FIGS. 9A and 9B are schematic plan views showing a liquid discharging method.
Figure 9B:
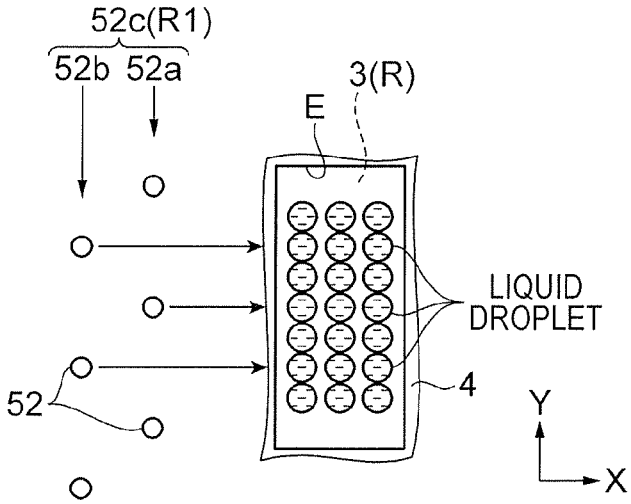

FIGS. 9A and 9B are schematic plan views showing an example of a method for discharging the liquids. At the discharging step, for example, as shown in FIG. 9A, when a longitudinal direction of the rectangular-shaped film formation regions E coincides with the sub scanning direction (the Y-axis direction), droplets are discharged from the nozzles 52 positioned over the film formation regions E during the main scanning. Since the nozzles 52 are arranged in the sub-scanning direction, more of the nozzles 52 become positioned over each of the film formation regions E during the main scanning. For example, during a first main scanning operation, regarding the discharging head R1 filled with a liquid containing the colored layer forming material of red (R), four nozzles 52 are positioned over the film formation region E to discharge each three droplets from each of the four nozzles 52.

Next, as shown in FIG. 9B, a second main scanning operation is performed to again discharge droplets so as to fill spaces between the droplets previously landed on the film formation region E. In other words, after completion of the first main scanning operation, the head R1 is moved in the sub-scanning direction to shift the nozzles 52 positioned over the film formation region E before discharging droplets. Thereby, five nozzles 52 are positioned over the film formation region E. Among them, three nozzles 52 nearer to a center of the substrate 1 are selected to discharge each three droplets from each of the selected nozzles. Performing the two times of the main scanning operations results in discharging of 21 droplets in total in the film formation region E.

When the discharging apparatus 10 discharges droplets in the above manner, the discharging operation is performed based on arrangement information of the droplets as the discharge control data. Thus, FIGS. 9A and 9B can be regarded to show bit map data as the arrangement information regarding an arrangement of the droplets in the film formation region E during each main scanning operation. In the liquid discharging method of the present embodiment, in the first and the second main scanning operations in FIGS. 9A and 9B, the driving signals COM are different that are supplied to the piezoelectric elements 59 of the nozzles 52 positioned over the film formation region E. Specifically, the driving signals COM are different in each nozzle group Gr positioned over the film formation region E in each main scanning operation.

FIGS. 10A and 10B are tables showing patterns driving signals selected for respective nozzle groups. As described above, the nozzle lines 52*a* and 52*b* of the liquid droplet discharging head 50 each have the 160 working nozzles equally divided into the four nozzle groups Gr-1 to Gr-4.

As shown in FIG. 10A, when the four driving signals COM-1 to COM-4 are assigned to the four nozzles groups Gr-1 to Gr-4, there are 28 selection patterns in total. Specifically, selection patterns 1 to 4, respectively, assign the same driving signal COM to the nozzle groups Gr-1 to Gr-4, whereas selection patterns 5 to 28, respectively, assign any one of the four driving signals COM-1 to COM-4 to each of the nozzle groups.

Basically, any of the 28 selection patterns can be used. However, given the Iw arch showing the variation of the discharge amount Iw in FIG. 4, the nearer to the opposite ends of the nozzle line 52*a* (the nozzle line 52*b*) the nozzles 52 are, the greater the discharge amount Iw tends to be. Thus, rather than the selection patterns 1 to 4 directly reflecting such a tendency, a combination of the nozzle groups Gr and the driving signals COM suppressing the tendency is preferable.

Specifically, as shown in FIG. 10B, four selection patterns 7, 9, 14, and 15 are preferable that exclude combinations of assigning the driving signals COM-3 and COM-4 having a large driving voltage Vh to the nozzle groups Gr-1 and Gr-4 positioned at the opposite ends of the nozzle line 52*a*. In this manner, variation of the discharge amount Iw among the nozzles 52 can be further suppressed, so that a predetermined amount of the liquid droplets can be stably discharged in the film formation region E.

In the main scanning operations shown in FIGS. 9A and 9B, the count and positions of droplets discharged during a single main scanning seem to be changed depending on the shape and size of the each film formation region E, the arrangement of the film formation regions E on the substrate 1, and the amount (volume or weight) of the liquid to be discharged in the film formation region E. Accordingly, it can be obviously considered that two or more times of the main scanning operations are needed.

In that case, as in the head unit 9 of the present embodiment, even when it is a single discharging head 5 that discharges a same kind of the liquid, the selection patterns of the driving signals COM can be changed in each main scanning operation, thereby reducing discharge unevenness due to the discharging characteristics of the head 50.

FIGS. 11A to 11C are schematic diagrams showing a method for performing a plurality of times of main scanning operations. Specifically, rectangular shapes shown by solid lines and imaginary lines represent the liquid droplet discharging heads 50, thereby indicating relative positions of the liquid droplet discharging heads 50 between or among the main scanning operations. In order to perform the main scanning operations, for example, as shown in FIG. 11A, the discharging head 50 is positioned within a range of the drawing width Lo to perform the plurality of times of the main scanning operations. The selection patterns of FIG. 10B described above are applied to the driving signals COM in a first main scanning operation and a second main scanning operation, whereby the driving signals COM-1 and COM-2, respectively, are selected for the nozzle groups Gr-1 and Gr-4, respectively. In this case, during the main scanning operations, the discharging head 50 is not moved in the sub-scanning direction (the Y-axis direction). In short, the liquid droplet discharging apparatus 10 requires no extra operation for driving the head moving mechanism 30 to move the discharging head 50.

Other than the above method, for example, as shown in FIGS. 11B and 11C, respectively, the liquid droplet discharging head 50 is moved so as to be deviated by ¼ or ½ of the drawing width Lo in the sub-scanning direction. A part of ¼ of the drawing width Lo corresponds to a single nozzle group Gr. Accordingly, sub-scanning for moving the discharging head 50 in the sub-scanning direction substantially on a per-nozzle-group basis is combined with main scanning to thereby perform drawing in a same region on the substrate 1.

As shown in FIG. 11B, when the discharging head 50 is deviated by ¼ of the Lo, a third main scanning operation for complementing the deviation is performed by using the nozzle group Gr 4.

As shown in FIG. 11C, when the discharging head 50 is deviated by ½ of the Lo, a third main scanning for complementing the deviation is performed by using the nozzle groups Gr-3 and Gr-4.

While the combination of the main scanning with the sub-scanning as above complicates operation of the liquid droplet discharging apparatus 10, the combination serve to increase ranges of combinations of the nozzle groups Gr positioned over the same region and selections of the driving signals COM, thereby further reducing influence of variation of the discharge amount Iw among the nozzles 52. As a result, the variation of the discharge amount can be suppressed, so that a predetermined amount of the liquid can be discharged in each film formation region E.

In the relative movement between the liquid droplet discharging head 50 and the workpiece W in the main scanning direction, a single main scanning operation may be divided into a forward movement and a backward movement or may include both of the forward and the backward movements. In addition, main scanning operations based on pieces of same arrangement information (same bit map data) of droplets may be regarded as a set of main scanning operations.

Thus, in the liquid discharging method of the embodiment, only the single droplet discharging head 50 discharges the same kind of the liquid. Nevertheless, changing the selection patterns for the driving signals COM in each main scanning operation can provide distribution effects of the nozzles, the nozzle groups, the nozzle lines, and the heads, as if a plurality of discharging heads 50 discharged the same kind of the liquid.

Next, at the film-formation step, the discharged liquid droplets are dried to form films of the colored layers 3 of the six colors. Drying methods include direct heating of the substrate 1 by a lamp heater or the like and pressure reduction/drying. Preferably, the latter drying method is used that can easily maintain a constant speed when drying a solvent of the liquid on the substrate 1.

In the method for producing the color filter 2 applying the liquid discharging method described above, a predetermined amount of the liquid of each color is discharged in each film formation region E while suppressing variation of the discharge amount. Accordingly, at the film-formation step, the colored layers 3 of the respective colors can be formed with a predetermined film thickness. As a result, the color filter 2 having desired optical characteristics can be produced in high yields.

Second Embodiment

Organic EL Device and Method for Producing Same

Figure 12:
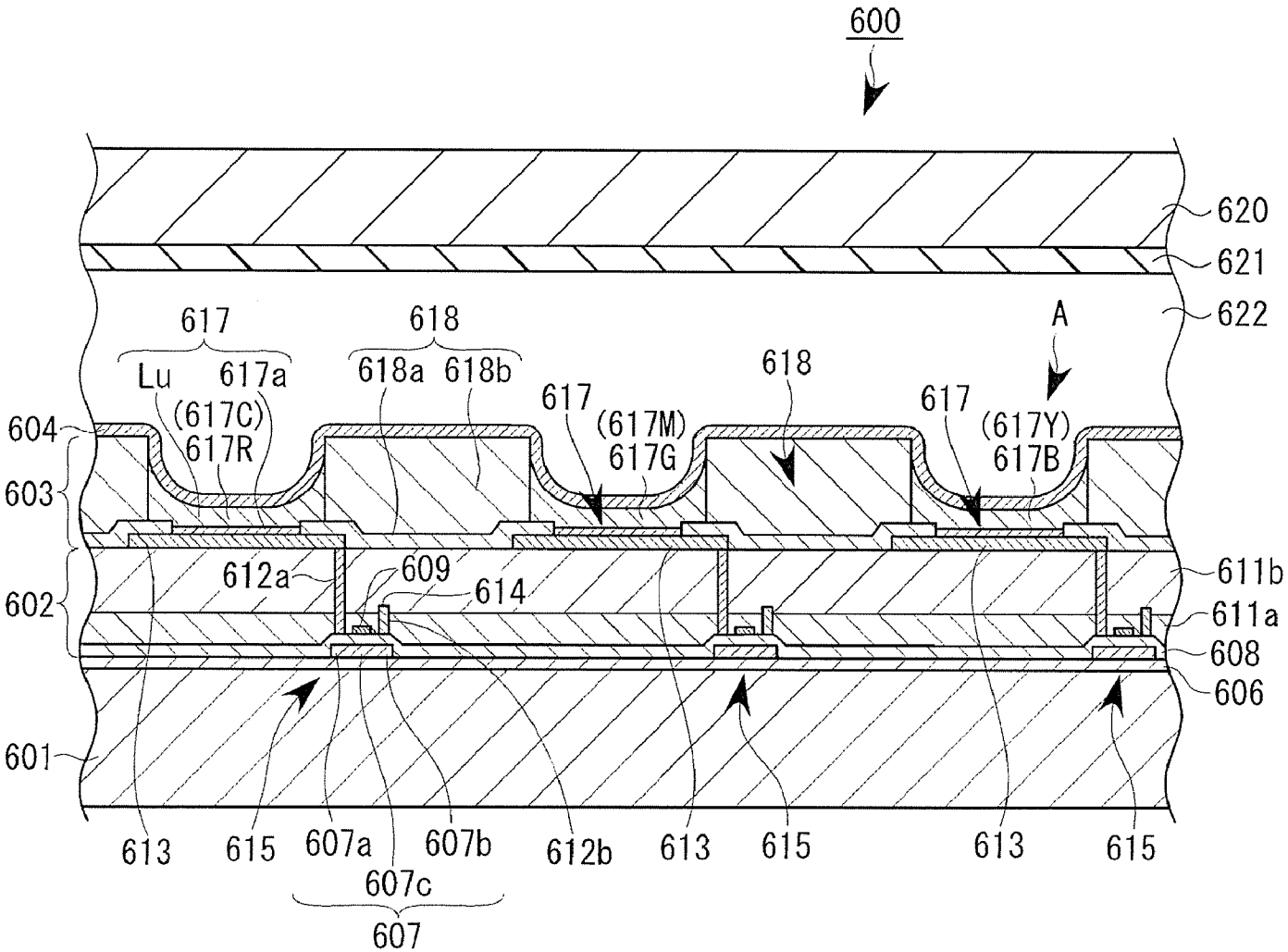
FIG. 12 is a schematic sectional view showing a structure of a main part of an organic EL device.
Figure 13A:
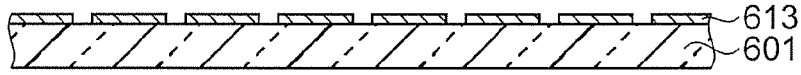
FIGS. 13A to 13F are schematic sectional views showing a method for producing the organic EL device.

With reference to FIG. 12 and FIGS. 13A to 12F, a description will be given of a method for producing an organic EL device performed by applying the liquid discharging method of the first embodiment. FIG. 12 is a schematic sectional view showing a structure of a main part of the organic EL device. FIGS. 13A to 13F are schematic sectional views showing the method for producing the organic EL device.

Organic EL Device

As shown in FIG. 12, an organic EL device 600 of the embodiment includes an element substrate 601 and a sealing substrate 620. The element substrate 601 includes a light emitting element section 603 as an organic EL element, and the sealing substrate 620 is spaced apart from the element substrate 601 via a space 622. The element substrate 601 also includes a circuit element section 602 above the substrate 601. The light emitting element section 603 is formed to be superimposed on the circuit element section 602 so as to be driven by the circuit element section 602. On the light element section 603, each of light emitting layers 617R, 617G, 617B, 617C, 617M, and 617Y having six different colors is formed on a light emitting layer formation region A as the film formation region so as to form a stripe shape. Above the element substrate 601, a single group of drawing elements is composed of six light emitting layer formation regions A corresponding to the six-color light emitting layers 617R to 617Y, and the drawing elements are arranged in a matrix on the circuit element section 602 of the element substrate 601. In short, the light emitting layers of the six colors are arranged in the same manner as in the colored layers 3 of the six colors in the color filter 2 of the first embodiment shown in FIG. 8A. The organic EL device 600 emits light from the light emitting section 603 toward the element substrate 601.

The sealing substrate 620 is made of glass or a metal and connected to the element substrate 601 via a sealing resin material. On a sealed inner surface of the sealing substrate 620 is attached a getter agent 621. The getter agent 621 absorbs water or oxygen entering in the space 622 between the element substrate 601 and the sealing substrate 620 to prevent the light emitting element section 603 from being deteriorated by the entry of water or oxygen into the space. However, the getter agent 621 may be omitted.

The element substrate 601 includes the circuit element section 602 with the light emitting layer formation regions A formed on the circuit element section 602. In addition, the element substrate 601 includes a bank 618 partitioning the light emitting layer formation regions A, an electrode 613 formed in each of the light emitting layer formation regions A, and a positive-hole injection/transport layer 617*a* laminated on each electrode 613. The element substrate 601 also includes the light emitting element section 603 having the light emitting layers 617R to 617Y. Those light emitting layers are formed by applying the respective six kinds of the liquids containing the light emitting layer forming material in the respective light emitting layer formation regions A. The bank 618 is made of an insulating material to cover a peripheral part of each of the electrodes 613 such that the electrodes 613 are not electrically short-circuited to the light emitting layers 617R to 617Y on the positive-hole injection/transport layers 617*a*.

The element substrate 601 is a transparent substrate made of glass or the like. On the element substrate 601 is formed a base protecting film 606 as a silicon oxide film, on which a semiconductor film 607 made of polycrystalline silicon is formed in an island shape. The semiconductor film 607 has a source region 607*a* and a drain region 607*b* formed by high-dose P-ion implantation. A part without any implanted P ions is referred to as a channel region 607*c*. In addition, a transparent gate insulating film 608 is formed to cover the base protecting film 606 and the semiconductor film 607. On the gate insulating film 608 are formed gate electrodes 609 made of Al, Mo, Ta, Ti, W, or the like. On the gate electrodes 609 and the gate insulating film 608 are formed a transparent first interlayer insulating film 611*a* and a transparent second interlayer insulating film 611*b*. Each of the gate electrodes 609 is disposed in a position corresponding to the channel region 607*c* of the semiconductor film 607. Furthermore, there are formed contact holes 612*a* and 612*b*, respectively, penetrating through the first and the second interlayer insulating films 611*a* and 611*b* to be connected to the source region 607*a* and the drain region 607*b*, respectively. On the second interlayer insulating film 611*b* are arranged transparent electrodes 613 made of indium tin oxide (ITO) or the like by patterning in a predetermined shape. Each of the electrodes 613 is connected to the contact hole 612*a*. The contact hole 612*b* is connected to a power supply line 614. In this manner, in the circuit element section 602, there are formed driving thin film transistors 615 connected to the electrodes 613. Additionally, the circuit element section 602 includes a retention capacitance and a switching thin film transistor, although not shown in the drawing.

The light emitting element section 603 includes the electrodes 613 as anodes, the positive-hole injection/transport layers 617*a*, the light emitting layers 617R to 617Y (referred generally to as "light emitting layers Lu"), the layers 617*a* and Lu being sequentially laminated on each electrode 613, and a cathode 604 laminated to cover the bank 618 and the light emitting layers Lu. Each positive-hole injection/transport layer 617*a* and each light emitting layer Lu form a function layer 617 to excite light emission. Providing the cathode 604, the sealing substrate 620, and the getter agent 621 made of a transparent material allows emitting light to be output from the sealing substrate 620.

The organic EL device 600 includes a scan line (not shown) connected to each gate electrode 609 and a signal line (not shown) connected to each source region 607*a*. When a scan signal transmitted to the scan line allows the switching thin film transistor (not shown) to be turned on, a potential of the signal line at the point in time is retained by the retention capacitance. A status of the retention capacitance determines on or off of each driving thin film transistor 615. Then, via the channel region 607*c* of the driving thin film transistor 615, electric current flows from the power supply line 614 to the electrodes 613, and then to the cathode 604 via the positive-hole injection/transport layer 617*a* and the light emitting layer Lu. The light emitting layer Lu emits light according to an amount of the electric current flowing through the light emitting layer Lu. The light emitting mechanism of the light emitting element section 603 enables the organic EL device 600 to display desired characters, images, and the like. In the organic EL device 600, the light emitting layers Lu are formed by using the liquid discharging method of the first embodiment. Thus, an approximately predetermined amount of the liquid is supplied in each light emitting layer formation region A, thereby reducing display problems such as light emission unevenness or luminescence unevenness. This can achieve high-quality and high-precision display.

Method for Producing Organic EL Device

Next will be described a method for producing the organic EL device 600 of the embodiment, with reference to FIGS. 13A to 13F. The drawings exclude the circuit element section 602 formed above the element substrate 601.

The method for producing the organic EL device 600 includes forming the electrode 613 in a position corresponding to each of the light emitting layer formation regions A of the element substrate 601, forming a bank 618 such that a part of the bank 618 is positioned over the electrode 613, performing surface-treatment of the light emitting layer formation regions A partitioned by the bank 618, discharging a liquid containing a positive-hole injection/transport layer forming material into each of the surface-treated light emitting formation regions A to draw the positive-hole injection/transport layer 617*a*, and drying the discharged liquid to form the positive-hole injection/transporting layer 617*a*. In addition, the method includes discharging the six kinds of the liquids containing the light emitting layer forming material in the light emitting layer formation region A, drying the six kinds of the liquids to form the light emitting layers Lu, forming the cathode 604 to cover the bank 618 and the light emitting layers Lu, and connecting the element substrate 601 including the light emitting element section 603 to the sealing substrate 620. Each kind of the liquid is supplied to the each light emitting layer formation region A by using the liquid discharging method of the first embodiment. Thus, the production method applies the arrangement of the liquid droplet discharging heads 50 in the head unit 9 shown in FIG. 3.

At a step of forming the electrodes (the anodes), as shown in FIG. 13A, the electrodes 613 are formed in the positions corresponding to the light emitting layer formation regions A of the element substrate 601. As an electrode forming method, for example, a transparent electrode film is formed using a transparent electrode material such as ITO on a surface of the element substrate 601 by sputtering or evaporation in vacuum. Then, while leaving only necessary parts, photolithographic etching is performed to form the electrodes 613. Next will be a bank forming step.

Figure 13B:
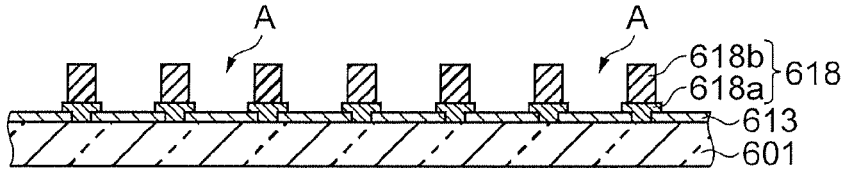

At the bank forming step, as shown in FIG. 13B, first, a lower layer bank 618*a* is formed to cover a part of the each electrode 613 on the element substrate 601. The lower layer bank 618*a* is made of insulating silicon oxide ($SiO_2$) as an inorganic material and is formed as follows, for example. First, a surface of each electrode 613 is masked with a resist or the like so as to correspond to the light emitting layer Lu formed later. The element substrate 601 with the mask is put in a vacuum device to perform sputtering or vacuum vapor deposition using $SiO_2$ as a target or a raw material, thereby forming the lower layer bank 618*a*. The mask such as a resist is removed after that. The lower layer bank 618*a* made of $SiO_2$ is sufficiently transparent when having a thickness of 200 nm or smaller. Thus, the lower layer bank 618*a* never disturbs light emission even when the positive-hole injection/transport layer 617*a* and then the light emitting layer Lu are formed later.

Next, an upper layer bank 618*b* is formed on the lower layer bank 618*a* to substantially partition the light emitting layer formation regions A. The upper layer bank 619*b* is made of, preferably, a material that is resistant against solvents of six kinds of liquids 100R, 100G, 100B, 100C, 100M, and 100Y, and more preferably, a material that can be made lyophobic by plasma treatment using fluorine gas, for example an organic material such as acryl resin, epoxy resin or photosensitive polyimide. To form the upper layer bank 618*b*, for example, the surface of the element substrate 601 having the lower layer bank 618*a* is coated with the photosensitive organic material mentioned above by roll coating or spin coating. Then, the coating material is dried to form a photosensitive resin layer having a thickness of approximately 2 μm. Next, a mask having openings each corresponding to a size of each light emitting layer formation region A is opposed to the element substrate 10 in a predetermined position to perform exposure and development, thereby forming the upper layer bank 618*b*. As a result, the bank 618 is obtained that includes the lower and the upper layer banks 618*a* and 618*b*. Next will be a surface treatment step.

At the step of performing the surface treatment of the light emitting layer formation regions A, first, plasma treatment using oxygen ($O_2$) gas is performed on the surface of the element substrate 601 having the bank 618 formed thereon. Thereby, the surfaces of the electrodes 613 and the surfaces of the bank 618 (including wall surfaces of the bank) are activated to be made lyophobic, which is followed by plasma treatment using fluorine gas such as $CF_4$. The fluorine gas causes reaction against the surface of only the upper layer bank 618*b* made of the photosensitive resin as the organic material to make the surface lyophobic. Next will be the positive-hole injection/transport layer forming step.

Figure 13C:
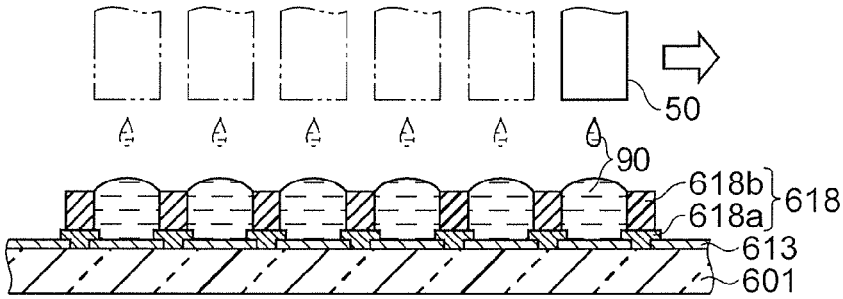

At the step of forming the positive-hole injection/transport layers, as shown in FIG. 13C, a liquid 90 containing a material of the positive-hole injection/transport layers is supplied in each of the light emitting layer formation regions A. The liquid 90 is discharged by the liquid discharging method of the first embodiment. The liquid 90, which is discharged as droplets from the liquid droplet discharging heads 50, lands and wettingly spreads on each of the electrodes 613 of the element substrate 601. According to a size of the each light emitting layer formation region A, an approximately predetermined amount of the liquid 90 is discharged as droplets. Next, a drying and film-formation step will be performed.

At the drying and film-formation step, the electrode substrate 601 is heated by lamp annealing or the like to dry and remove a solvent component of the liquid 90. Thereby, each positive-hole injection/transport layer 617*a* is formed in the light emitting layer formation region A partitioned by the bank 618 on the electrode 613. In the present embodiment, the positive-hole injection/transport layers are made of 3,4-polyethylene-dioxy-thiophene/polystyrene sulfonate (PEDOT/PSS). In the embodiment, the positive-hole injection/transport layers 617*a* formed in the light emitting layer formation regions A are made of the same material. However, in accordance with the light emitting layers Lu formed later, the material of the positive-hole injection/transport layers 617*a* may be made different among the light emitting layer formation regions A. Next will be a liquid discharging step.

Figure 13D:
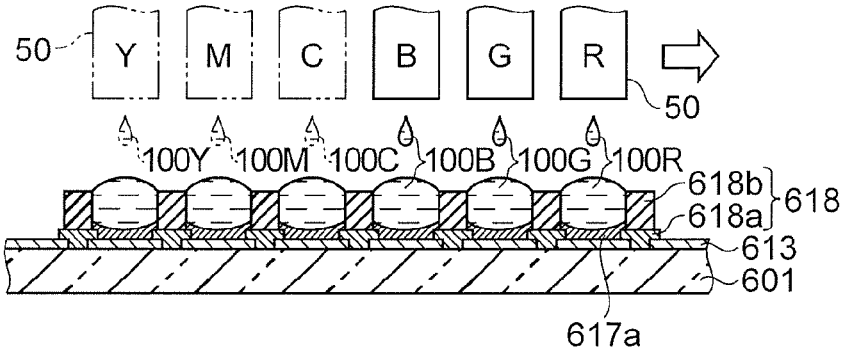

At the liquid discharging step, as shown in FIG. 13D, the liquid droplet discharging apparatus 10 discharges the six kinds of the liquids 100R to 100Y containing the light emitting layer forming material to the light emitting layer formation regions A from the liquid droplet discharging heads 50. The liquids 100R, 100G, 100B, 100C, 100M, and 100Y, respectively, contain a material that forms the light emitting layers 617R (red), 617G (green), 617B (blue), 617C (cyan), 617M (magenta), and 617Y (yellow), respectively.

The light emitting layer forming material is a well-known light emitting material capable of emitting fluorescent or phosphorescent light.

Specifically, preferable examples of the light emitting layer forming material include (poly)fluorene derivatives (PF), (poly)paraphenylene vinylene derivatives (PPV), polyphenylene derivatives (PP), polyparaphenylene derivatives (PPP), polyvinyl carbazole (PVK), polythiophene derivatives, and polysilanes such as poly(methyl phenyl silane) (PMPS). In addition, polymeric materials such as perylene pigments, coumarin pigments, and rhodamine pigments, or low-molecular-weight materials such as rubrene, perylene, 9,10-diphenyl-anthracene, tetraphenyl butadiene, Nile red, coumarin 6, and quinacridone may be doped into the above-mentioned preferable high polymers.

The landed liquids 100R to 100Y wettingly spread in the light emitting layer formation regions A, causing a rise of sections of the liquids in an arc shape. The liquids 100R to 100Y are supplied by using the liquid discharging method of the first embodiment. Next will be a step of forming drying and forming a film of each light emitting layer.

Figure 13E:
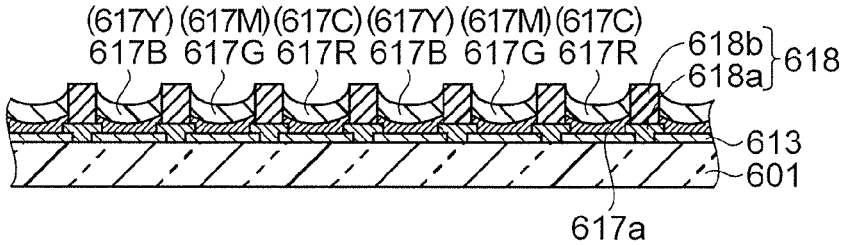

At the drying and film-formation step, as shown in FIG. 13E, solvent components of the discharged liquids 100R to 100Y are dried and removed to form films of the respective light emitting layers 617R to 617Y such that those layers are laminated on the positive-hole injection/transport layers 617*a* in the light emitting layer formation regions A. The element substrate 601 including the discharged liquids 100R to 100Y is dried, preferably, by reduced pressure drying capable of maintaining an evaporation rate of the solvent components at an approximately constant level. Next will be a cathode forming step.

Figure 13F:
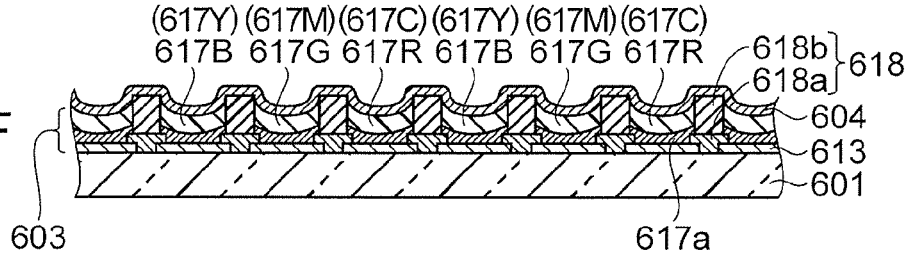

At the cathode forming step, as shown in FIG. 13F, the cathode 604 is formed so as to cover the surfaces of the light emitting layers 617R to 617Y and of the bank 618 on the element substrate 601. A preferable material of the cathode 604 is a combination of a metal such as Ca, Ba, or Al and a fluoride such as LiF. More preferably, a film made of Ca, Ba, or LiF having a small work function is formed nearer to the light emitting layers 617R to 617Y, whereas a film made of Al or the like having a large work function is formed farther from the light emitting layers. In addition, a protecting layer made of $SiO_2$ or SiN may be laminated on the cathode 604 to prevent oxidation of the cathode 604. The cathode 604 is formed by evaporation, sputtering, chemical vapor deposition (CVD) or the like. Among them, evaporation is preferable, since evaporation can prevent heat-induced damage to the light emitting layers 617R to 617Y.

On the element substrate 601 completed as above, a predetermined amount of each of the liquids 100R to 100Y is supplied as droplets in each different light emitting layer formation region A while suppressing variation of the discharge amount. Then, after the step of drying and film formation, the light emitting layers 617R to 617Y (referred generally to as the light emitting layers Lu) are formed with an approximately predetermined film thickness in the light emitting layer formation regions A. Next will be a sealing step.

At the sealing step, the element substrate 601 including the light emitting element section 603 is opposed and bonded to the sealing substrate 620 with an adhesive via the space 622 (See FIG. 12). A preferable adhesive is a durable thermosetting epoxy resin adhesive or the like. In this manner, the light emitting element section 603 is sealed.

In the method for producing the organic EL device 600 of the second embodiment, at the step of discharging the liquids 100R to 100Y, the liquid discharging method of the first embodiment is used to discharge droplets of the liquids. Accordingly, the approximately predetermined amount of the liquids 100R to 100Y are stably supplied in the respective light emitting layer formation regions A. Thereby, in the light emitting layer formation regions A, the formed light emitting layers Lu can have an approximately predetermined thickness after the drying and film formation processes.

Since each of the light emitting layers Lu has the approximately predetermined thickness, the each light emitting layer Lu also has an approximately predetermined resistance. This can reduce display-related problems such as light emission unevenness and luminescence unevenness due to uneven resistance of the each light emitting layer Lu, when the circuit element section 602 applies a driving voltage to the light emitting element section 603 to cause light emission. Therefore, the organic EL device 600 can be produced in high yields and can reduce light emission unevenness, luminescence unevenness, and other display problems, as well as can achieve high color reproducibility.

Other than the above embodiments, various modifications can be considered. Hereinafter, some modifications will be described.

First Modification

Figure 14:
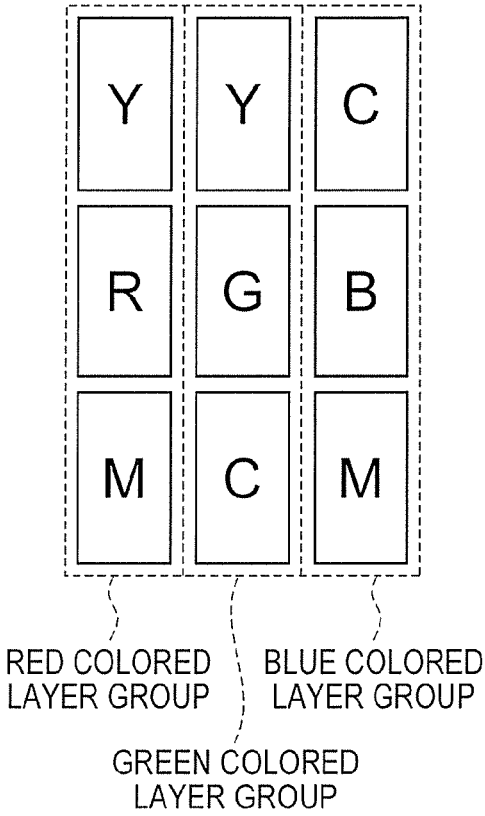
FIG. 14 is a schematic plan view showing an arrangement of colored layers in a modification of the above color filter.

In the color filter 2 of the first embodiment, the arrangement of the colored layers 3 of the six colors (R to Y) is not restricted to that described above. FIG. 14 is a schematic plan view showing an arrangement of the colored layers according to a first modification. For example, there are color additive rules: R=Y+M; G=C+Y; and B=M+C. Adjusting a ratio of adding Y to M can provide a subtle color tone close to R. Similarly, adjusting a ratio of C to Y and a ratio of M and C, respectively, can provide a subtle color tone close to G and a subtle color tone close to B, respectively. Accordingly, as shown in FIG. 14, colored layers 3 of three colors (R, Y, and M), colored layers 3 of three colors (G, C, and Y), and colored layers 3 of three colors (B, M, and C), respectively, may form a red colored layer group, a green colored layer group, and a blue colored layer group, respectively, such that the three kinds of the color groups are arranged vertically or laterally. In other words, although the colored layers 3 included in the single picture element have the six colors, there are nine colors in total provided by the color groups. In addition, the color filter 2 of the first modification can be produced by using the method for producing the color filter 2 of the first embodiment.

Second Modification

The color filter 2 produced using the color filter production method of the first embodiment is not restricted to the filter having the colored layers 3 of the six colors. For example, the color filter 2 may have three colors: R, G, and B. In other words, even when only the single liquid droplet discharging head 50 discharges the same kind of liquid, the nozzle distribution effect can be exhibited as if a plurality of liquid droplet discharging heads 50 discharged the same kind of the liquid.

Third Modification

In the organic EL device 600 of the second embodiment, the light emitting element section 603 as the organic EL element may have a structure different from that described above. For example, a function layer 617 is formed in the each light emitting layer formation region A to emit a white color of light. Then, the color filter 2 is arranged so as to be adjacent to the sealing substrate 620. Thereby, the organic EL device 600 produced can be made into a top emission type having full-color display capabilities and high color reproducibility.

The entire disclosure of Japanese Patent Application No. 2008-94724, filed Apr. 1, 2008 is expressly incorporated by reference herein.

What is claimed is:

1. A liquid discharging method comprising:

preparing a substrate having a plurality of film formation regions;

allowing a plurality of nozzles to face the substrate, the nozzles forming at least one nozzle line including a plurality of nozzle groups;

moving the substrate and the nozzles relatively with respect to each other in a first direction to perform first and second scanning operations;

generating a plurality of driving signals respectively by a plurality of D/A converters with a number of the driving signals corresponding to a number of the nozzle groups, the driving signals being different from each other and including at least a first driving signal and a second driving signal generated respectively by a first D/A converter and a second D/A converter;

discharging a liquid as a droplet from at least one of the nozzles of one of the nozzle groups onto one of the film formation regions during the first scanning operation by applying the first driving signal to a driving unit of the at least one of the nozzles; and discharging the liquid as a droplet from the at least one of the nozzles onto the one of the film formation regions during the second scanning operation by applying the second driving signal to the driving unit of the at least one of the nozzles thereby changing discharge amounts of the droplets from the at least one of the nozzles between the first scanning operation and the second scanning operation.

2. The liquid discharging method according to claim 1, wherein when discharging the liquid, the at least one nozzle line is moved in a second direction orthogonal to the first direction during the first and second scanning operations to allow droplets to be discharged from a different group of the nozzle groups in each of the film formation regions by the first and second scanning operations.

3. A color filter producing method, comprising:

discharging a plurality of different colors of liquids each containing a colored layer forming material in a plurality of different film formation regions by using the liquid discharging method of claim 1; and solidifying the discharged liquids to form films of a plurality of colored layers each having a different color in the regions.

4. A method for producing an organic EL device including an organic EL element with a functional layer including a light emitting layer, the method comprising:

discharging a liquid containing a light emitting layer forming material in a plurality of film formation regions on a substrate by using the liquid discharging method of claim 1; and solidifying the discharged liquid to form a film of the light emitting layer in each of the regions.

* * * * *